US006626435B1

(12) United States Patent
Kanamori

(10) Patent No.: US 6,626,435 B1
(45) Date of Patent: Sep. 30, 2003

(54) AUTOMATIC PAI GOW TABLE SYSTEM

(76) Inventor: Shigeru Kanamori, c/o Kanamori Seisakusho Co., Ltd., 8-16, Ohmoriminami 2-chome, Ohta-ku, Tokyo (JP)

( * ) Notice: Subject to any disclaimer, the term of this patent is extended or adjusted under 35 U.S.C. 154(b) by 0 days.

(21) Appl. No.: 09/582,427

(22) PCT Filed: Dec. 28, 1998

(86) PCT No.: PCT/JP98/05986

§ 371 (c)(1),
(2), (4) Date: Aug. 22, 2000

(87) PCT Pub. No.: WO99/36145

PCT Pub. Date: Jul. 22, 1999

(30) Foreign Application Priority Data

| | | |
|---|---|---|
| Dec. 27, 1997 | (JP) | 9-369184 |
| Dec. 27, 1997 | (JP) | 9-369185 |
| Dec. 27, 1997 | (JP) | 9-369186 |
| Dec. 27, 1997 | (JP) | 9-369187 |
| Dec. 27, 1997 | (JP) | 9-369188 |

(51) Int. Cl.[7] ..... A63F 9/24
(52) U.S. Cl. ..... 273/309; 273/144 A; 273/149 R
(58) Field of Search ..... 273/309, 144 A, 273/149 R

(56) References Cited

U.S. PATENT DOCUMENTS

| | | | | |
|---|---|---|---|---|
| 3,899,178 | A | * | 8/1975 | Watanabe |
| 4,219,200 | A | * | 8/1980 | Takahashi |
| 4,264,074 | A | * | 4/1981 | Sobajima |
| 5,275,411 | A | * | 1/1994 | Breeding |
| 5,695,189 | A | * | 12/1997 | Breeding et al. |

FOREIGN PATENT DOCUMENTS

| | | | |
|---|---|---|---|
| GB | 2247006 | * | 2/1992 |
| JP | 49-85283 | | 7/1974 |
| JP | 50-25337 | | 3/1975 |
| JP | 60-96281 | | 5/1985 |
| JP | 60-114290 | | 6/1985 |
| JP | 60-129988 | | 8/1985 |
| JP | 62-33891 | | 2/1987 |
| JP | 62-36789 | | 3/1987 |
| JP | 62-114579 | | 5/1987 |
| JP | 9-10431 | | 1/1997 |

OTHER PUBLICATIONS

USPTO Translation of 49–85283, 1972.*
USPTO Translation of 50–25337, 1975.*
USPTO Translation of 60–129988, 1985.*
USPTO Translation of 60–114290, 1985.*
USPTO Translation of 60–96281, 1985.*
USPTO Translation of 62–36789, 1987.*
USPTO Translation of 62–114579, 1987.*
USPTO Translation of 9–10431, 1997.*

* cited by examiner

*Primary Examiner*—Michael O'Neill
(74) *Attorney, Agent, or Firm*—Lorusso, Loud & Kelly

(57) ABSTRACT

The automatic Pai Gow table system for playing a Pai Gow game with pieces, having a playing table section with a piece inlet port and a piece outlet port, a plurality of leg members supporting the playing table section, and a main apparatus body section disposed underneath the playing table section.

31 Claims, 34 Drawing Sheets

AUTOMATIC PAI GOW TABLE SYSTEM

TECHNICAL FIELD

The present invention relates to an automatic Pai Gow table system for use in playing a Pai Gow game with pieces.

BACKGROUND TECHNOLOGY

"Pai Gow" games are one of traditional games with pieces created in China and called "piagoo" or "piagow" in the United States. Cards for use with the Pai Gow games are thinner and more slender than Mahjong tiles and are provided each with a mark, like spots of dice, on a one face thereof and with no mark on the other face thereof. In another words, each of the pieces comprises a marked face and plain face. The Pai Gow game is played in a manner that the dealer gives a plural number of pieces to the players and the winner is decided on the basis of a combination of the pieces.

Typically, the dealer manages all work for the Pai Gow games, including, for example, mixing the pieces, arranging the pieces into a set of the pieces, supplying the pieces to the players, and so on. This work is incorporated as a playing time so that one game may take a long time. There is the demand and desires to shorten the playing time and play more games in a predetermined time. Moreover, the players always have some anxiety about fairness involved in the game due to the exclusive management by the dealer alone so that it is greatly demanded and desired to develop a system that does not or little require manual work by the dealer and that can ensure fairness in playing games.

DISCLOSURE OF THE INVENTION

In order to solve the disadvantages prevailing in the conventional Pai Gow games, the present invention has the object to provide an automatic Pai Gow table system that can automatically carry out all work involved in, for example, mixing pieces, arranging pieces into a set, supplying the set, and the like, without requiring any substantial manual work by the dealer.

Therefore, the present invention provides an automatic Pai Gow table system having a playing table section provided with a piece inlet port and a piece outlet port, a plurality of leg members supporting the playing table section, and a main apparatus body section disposed underneath the playing table section, said system being used for playing a game with pieces fed from said piece outlet port; wherein the main apparatus body section comprises:

- a pieces-mixing and arranging means for mixing the pieces cast from the piece outlet port of the playing table section and transferring the pieces one to a predetermined location by one after mixing;
- a face-determining means for determining a top face with a mark provided thereon or a back face with no mark provided thereon of each piece transferred from the pieces-mixing and arranging means;
- a face-turning means for turning a face of the piece on the basis of a result of determination by the face-determining means by reversing the top face of the piece to the back face thereof when it is determined that the top face of the piece is directed upward and by allowing the piece to pass while staying the top face thereof directed downward without turning the face thereof when it is determined that the back face of the piece is directed upward;

- a pieces-pushing and arranging means for pushing out the piece with the back face thereof directed upward and the top face thereof directed downward to a predetermined position and arranging the pieces therein for a set of the pieces having a predetermined number of pieces in a row and rows; and
- a pieces-set pushing and transferring means for pushing out the set of the pieces arranged by the pieces-pushing and arranging means to a predetermined position and then transferring the set of the pieces to a piece inlet port on a surface of the playing table section.

BRIEF DESCRIPTION OF THE ACCOMPANYING DRAWINGS

BEST MODES FOR CARRYING OUT THE INVENTION

The present invention will be described in more detail regarding an automatic Pai Gow table system in its preferred embodiments with reference to the accompanying drawings.

Figure 1:
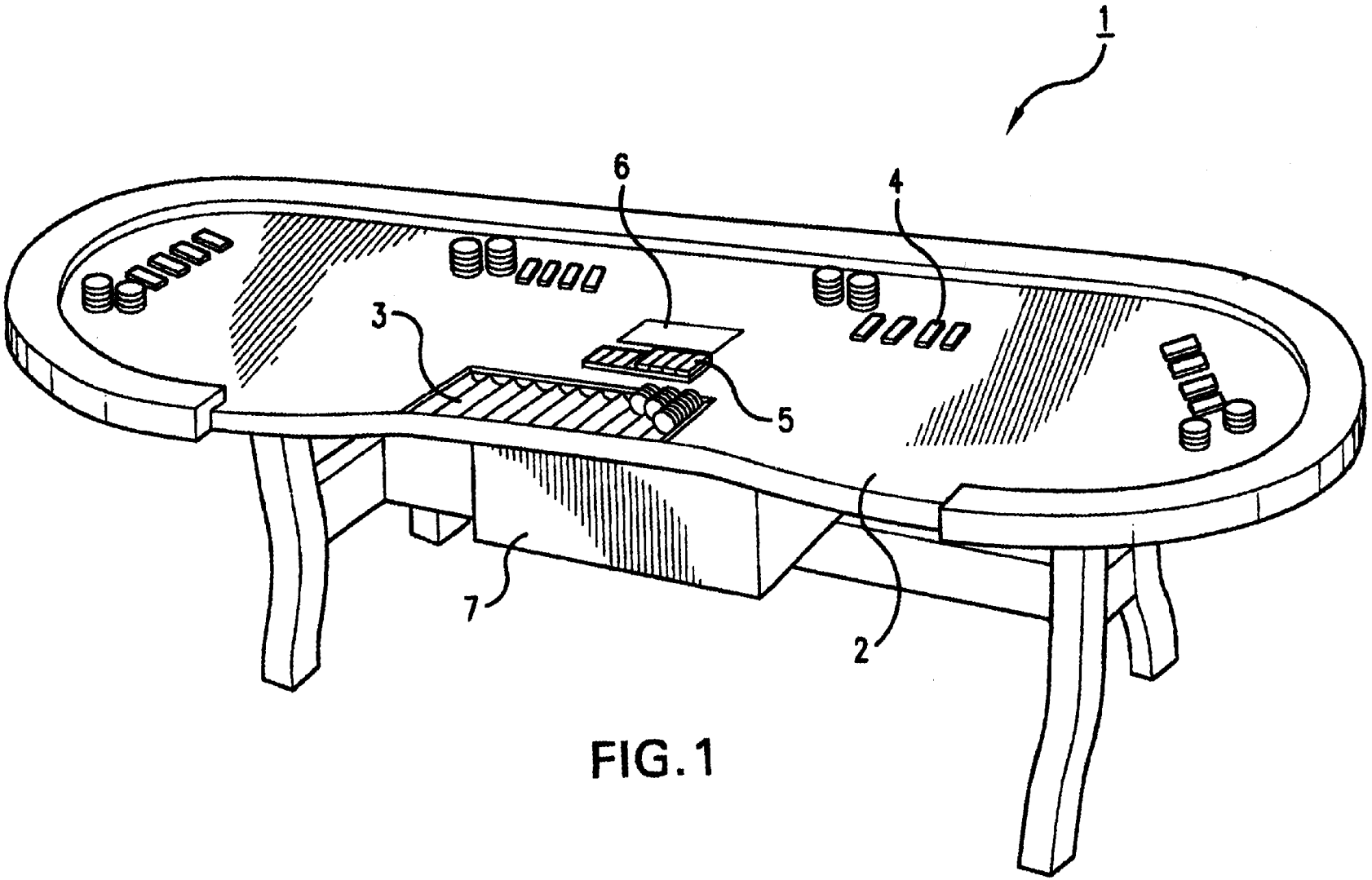
FIG. 1 is a perspective view showing an overall outlook of an automatic Pai Gow table system according to the present invention.
Figure 2:
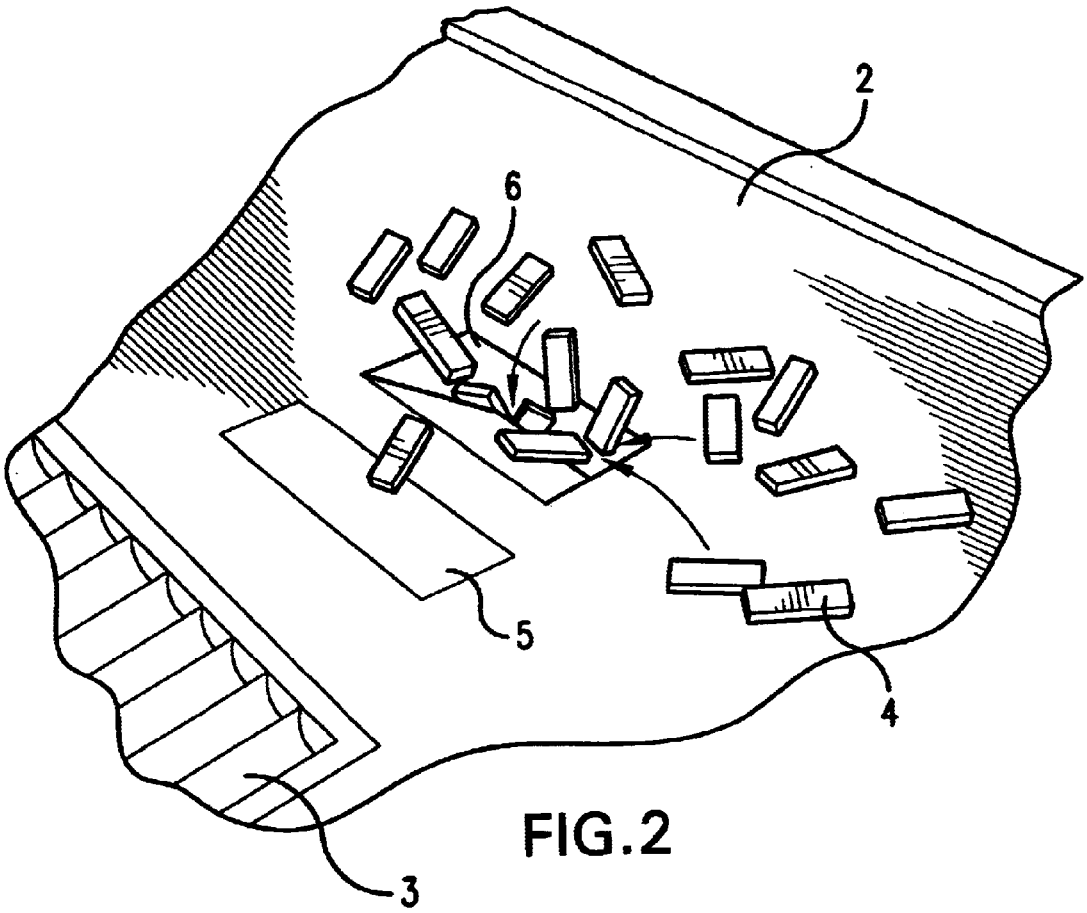
FIG. 2 is a view showing the status of discharging pieces from a playing table of the table system.
Figure 3:
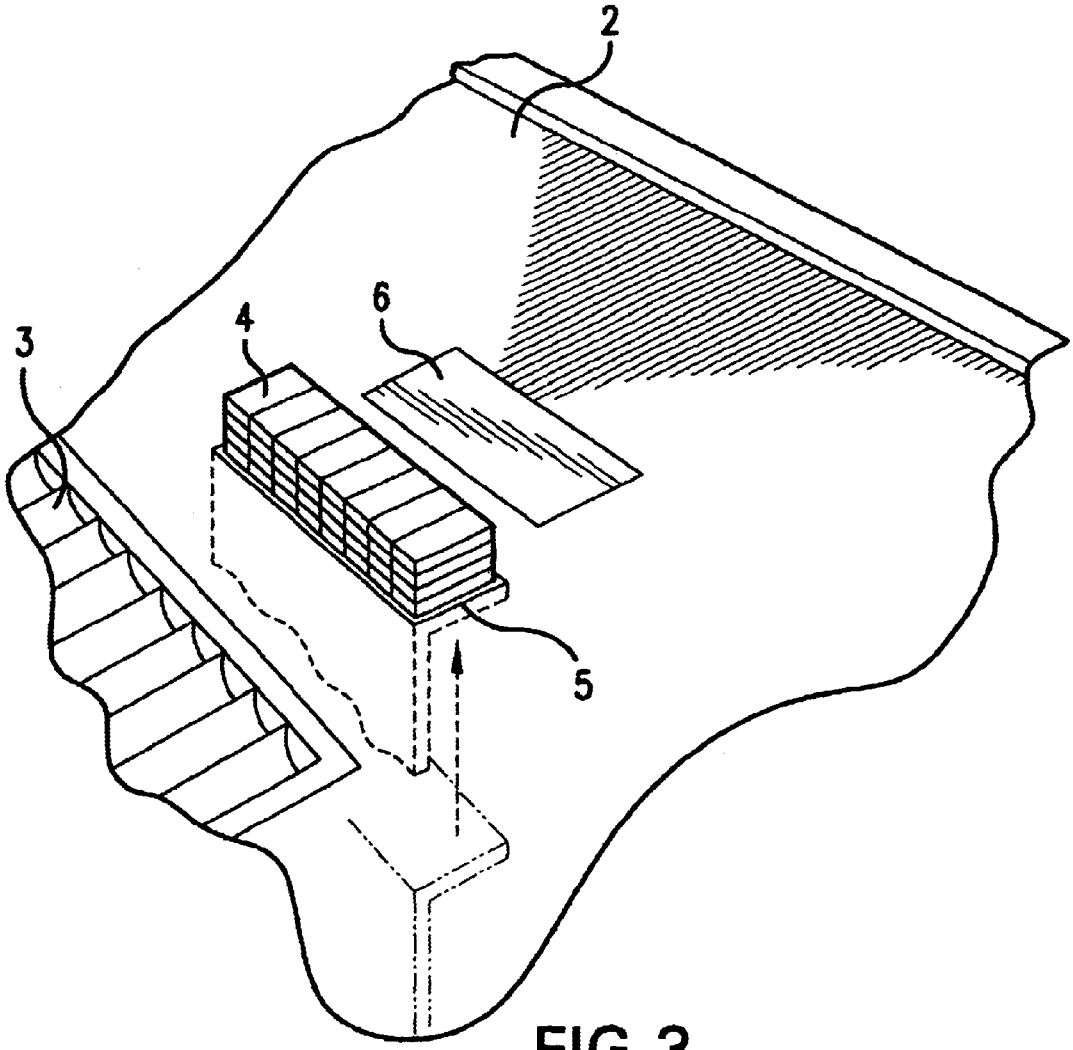
FIG. 3 is a view showing the status in which a new set of pieces are supplied onto the playing table.
Figure 4A:
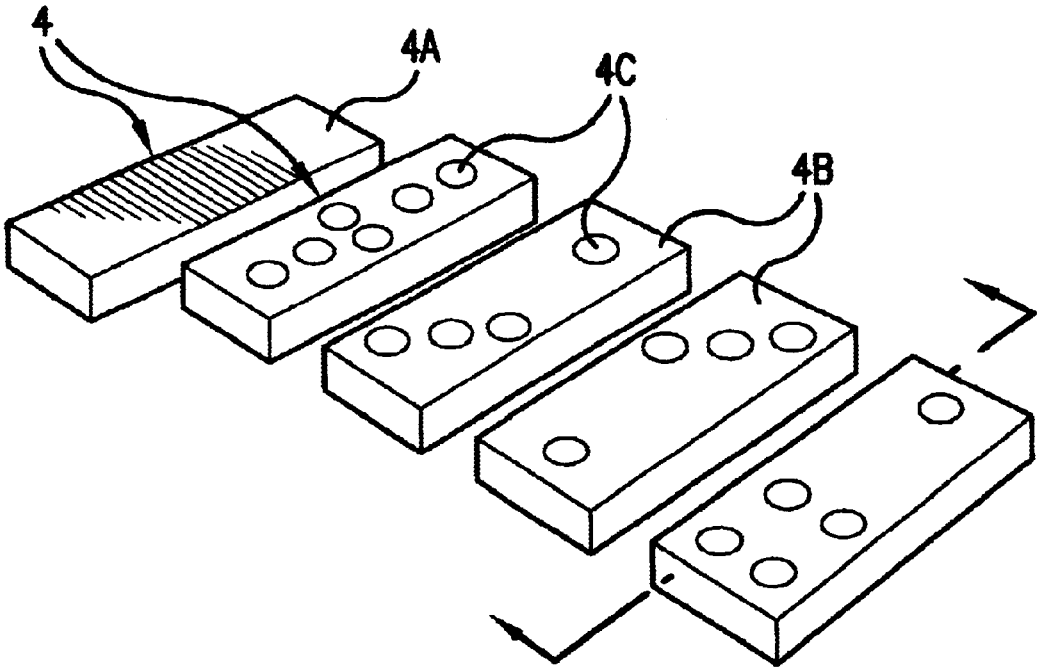
FIG. 4A is a perspective view showing pieces for use in the present invention.
Figure 4B:
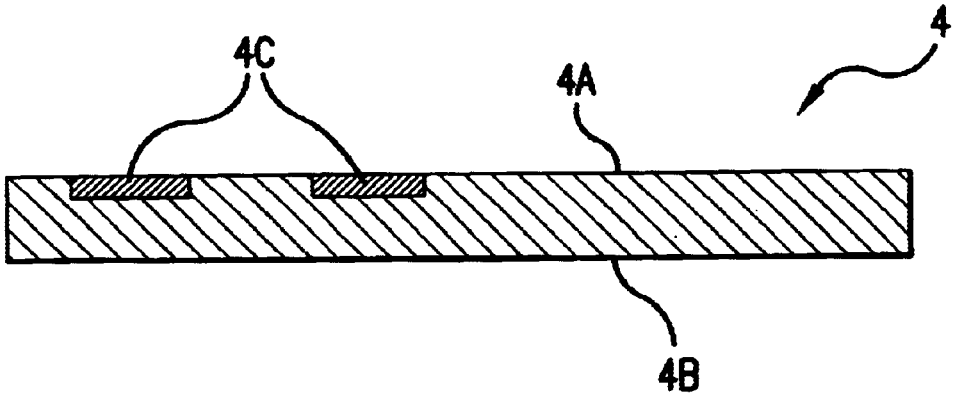
FIG. 4B is a view in section showing a piece for use in the present invention.

FIG. 1 is a perspective view showing an overall outlook of a Pai Gow table system according to the present invention. As shown in FIG. 1, an automatic Pai Gow table system 1 comprises a playing table 2, a chip placement area 3, Pai Gow pieces 4, a piece inlet port 5, a piece outlet port 6, and a main apparatus body 7. FIG. 2 shows a status in which the pieces 4 are discharged from the piece outlet port 6 into the main apparatus body 7 after the game was over. FIG. 3 shows a status in which an arranged set of the pieces 4 is taken out from the main apparatus body 7 for a new game. FIG. 4A shows a perspective view of Pai Gow pieces 4 and FIG. 4B shows a sectional side view thereof. Each Pai Gow piece 4 comprises a plain face, as shown in FIG. 4A, and a marked face provided with an inscribed mark 4C, as shown in FIG. 4B. For this system, a total number of 32 pieces are used for one game as one set, and two sets of the pieces are alternately used for playing games. And eight persons can play the game at once. While one set of the pieces is being used for a game, another set of the pieces is being processed automatically in the main apparatus body 7 of the apparatus for arranging the pieces into a new set of the pieces (consisting of eight pieces in a row and four rows). The pieces are arranged in a series of actions including, for example, mixing together the pieces used in the immediately previous game and discharged from the playing table, directing all the particular faces of the pieces to a predetermined direction only, arranging a set of the pieces for supplying onto the playing table for playing a new game, and so on. Once the game was over, all the pieces used for the game were discharged through the piece outlet port 6 from the playing table and introduced into the main apparatus body 7 and a new set of the pieces is supplied through the piece inlet port 5 onto the playing table for ready for another game immediately.

Figure 5:
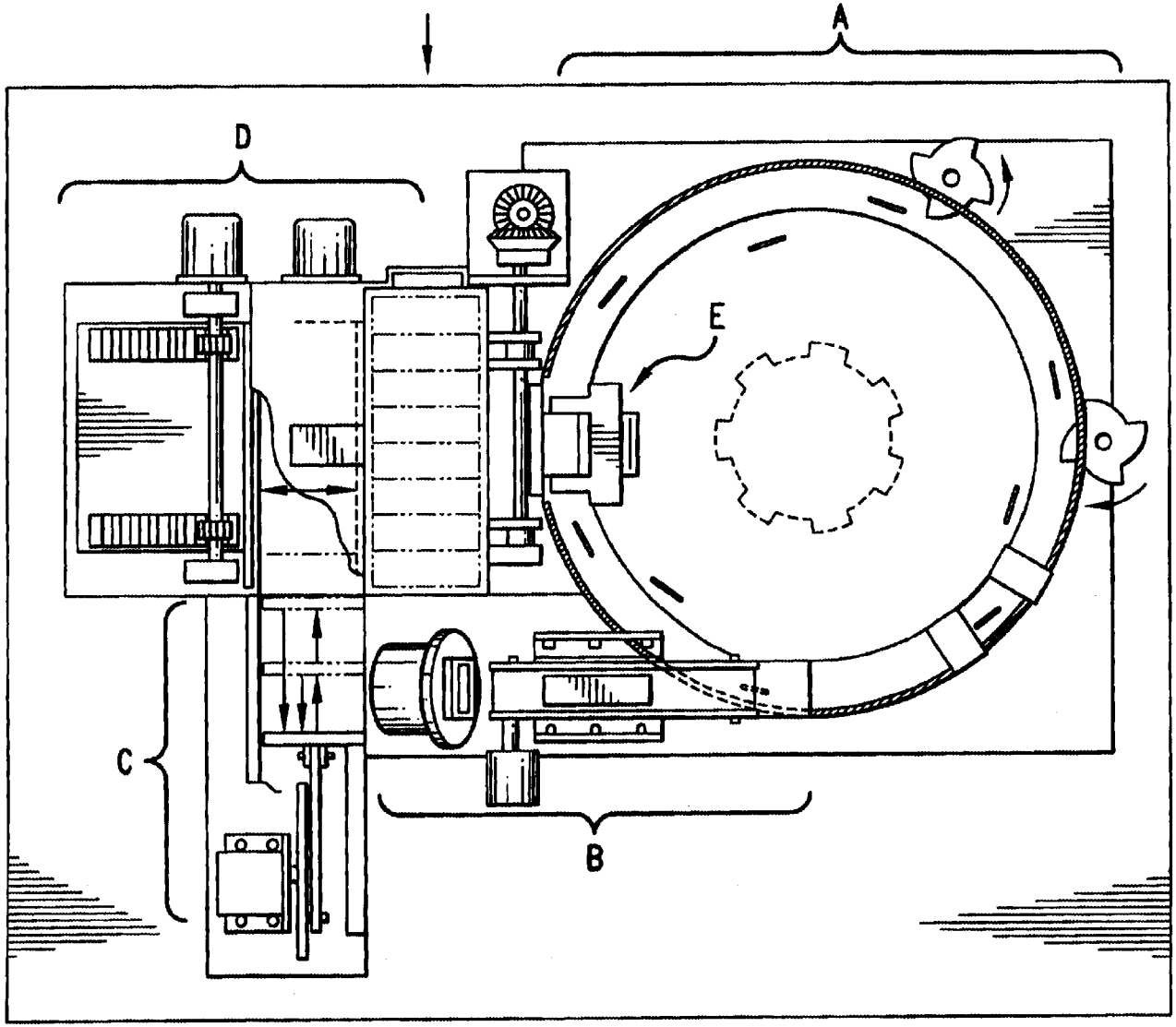
FIG. 5 is a plan view showing a main apparatus body of the Pai Gow table system according to an embodiment of the present invention.
Figure 6:
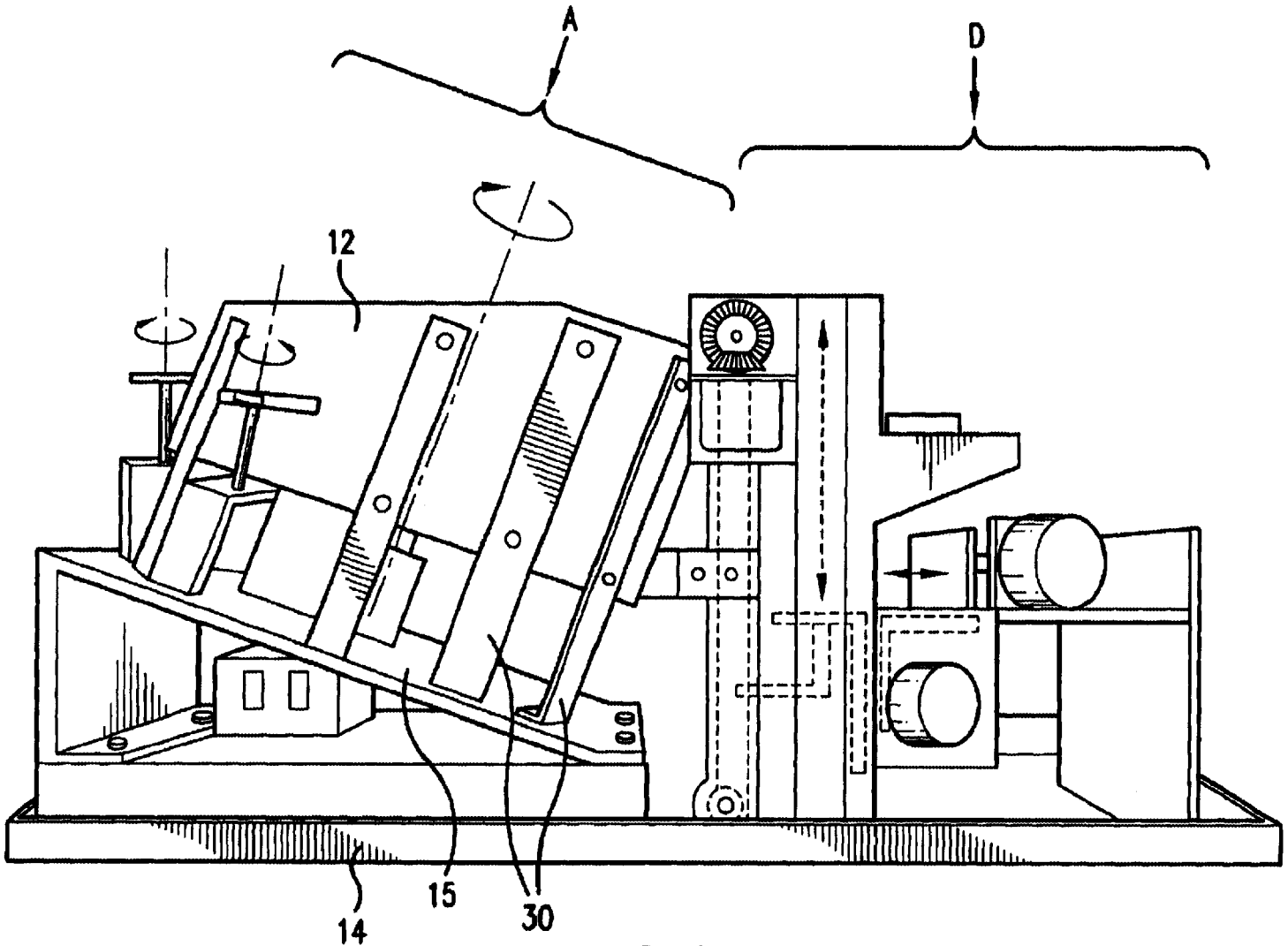
FIG. 6 is a side view showing a portion directed by the arrow in FIG. 5.

FIG. 5 shows a plan view of the main apparatus body 7 of the automatic Pai Gow table system 1 according to an embodiment of the present invention. FIG. 6 shows a view of the main apparatus body 7 thereof, when looked at from the arrow as shown in FIG. 5. As shown in FIG. 5, the main apparatus body 7 of the automatic Pai Gow table system 1 is divided roughly into five mechanisms which may include, for example, a pieces-mixing and arranging mechanism A, a pieces-determining and turning mechanism B, a pieces-pushing and arranging mechanism C, a pieces-set pushing and raising mechanism D, and a pieces-entry door-opening and closing mechanism E. The pieces-mixing and arranging mechanism A is to mix the pieces together in a random fashion and transferring the pieces one by one to a predetermined location. The pieces-determining and turning mechanism B is to determine a plain face (a rear face) and a marked face (a top face) of each piece transferred from the pieces-mixing and arranging mechanism A and to allow all the pieces to direct the particular faces thereof upward. As the pieces have been transferred to the pieces-pushing and arranging mechanism C while the marked faces of all the pieces are directed downward, the pieces are then pushed one by one to form an array of eight pieces in a row and then to overlay another array of eight pieces arranged in a row onto the first row of the eight pieces, eventually forming a set of the pieces of 32 pieces consisting of four rows. The set of the pieces arranged so is then transferred to a predetermined position and raised for the supply through the piece inlet port 6 onto the playing table by means of the pieces-set pushing and raising mechanism D after the previous game was over and all the pieces are removed from the playing table. The pieces used for the game are discharged from the playing table and introduced into the main apparatus body 7 by means of the pieces-entry door-opening and closing mechanism E. A control unit (not shown) is provided in order to control the action of each mechanism in electrical and electronic ways.

The configuration and action of each mechanism will be described in more detail.

Pieces-mixing and Arranging Mechanism A

Figure 7:
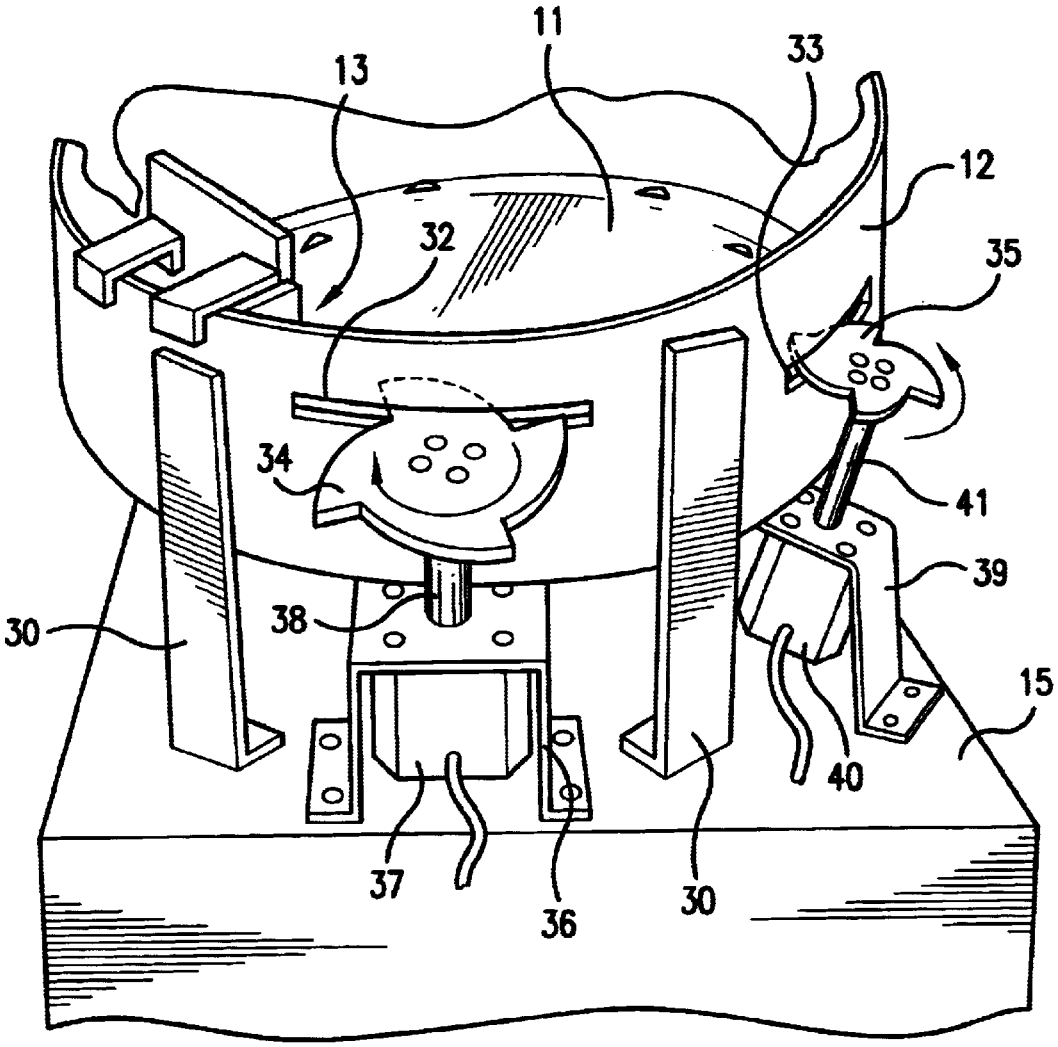
FIG. 7 is a perspective view showing a pieces-mixing and arranging mechanism.

The pieces-mixing and arranging mechanism A is a mechanism for mixing together all pieces of a set used in the previous game in a random fashion for the next game, which were discharged from the playing table and introduced through the piece outlet port 6 into the main apparatus body 7 after the previous game was over, and for transferring the pieces one by one toward a predetermined location. As shown in FIG. 7, the pieces-mixing and arranging mechanism A comprises a rotatable turn table 11 that can be rotated in both directions, an annular peripheral wall 12 enclosing the rotatable turn table 11, and a piece outlet port 13 for discharge of the pieces to a pieces guide passage 51 as will be described hereinafter.

Figure 8:
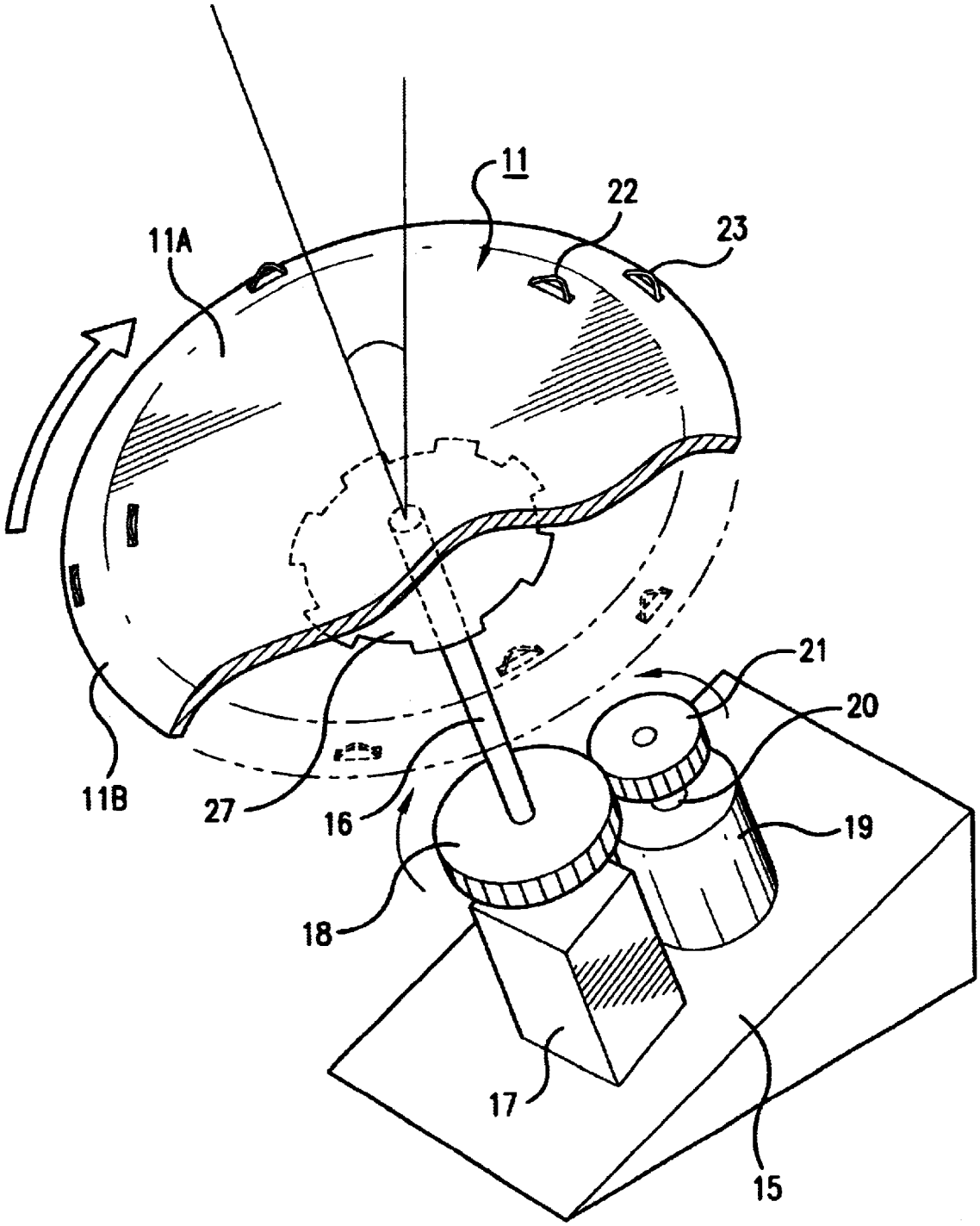
FIG. 8 is a schematic view showing a turn table and a drive system.

The rotatable turn table 11 is mounted on a mounting base 15 so as for its top surface to become parallel thereto, the mounting base 15 being in turn mounted at a predetermined angle on a base table 14 (FIG. 6) of the main apparatus body 7. More specifically, as shown in FIG. 8, the rotatable turn table 11 is fixed at its central bottom portion to a one end of a rotary shaft 16. The other end of the rotary shaft 16 is rotatably supported by means of a shaft support member 17 that in turn is disposed upright on the mounting base 15. A gear 18 is secured to the rotary shaft 16 at an appropriate position. At another position of the mounting base 15 is mounted a step motor (or a stepping pulse motor) 19 for driving the rotation of the turn table. A gear 21 is secured to a top of an output shaft 20 of the step motor 19, and the gear 21 is in mesh with the gear 18. An angle of inclination of the rotatable turn table 11 is set at approximately 20° in this embodiment. It is to be noted, however, that the angle of inclination of the rotatable turn table 11 is not restricted to this particular one and it may be set at any appropriate angle as long as the pieces can be mixed in an optimum fashion.

Figure 9A:
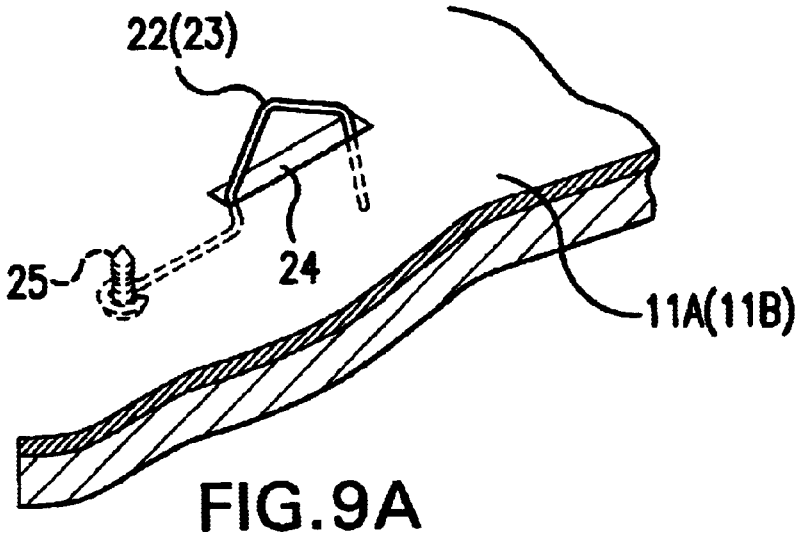
FIG. 9A is a schematic view explaining the configuration of a spring member.
Figure 9B:
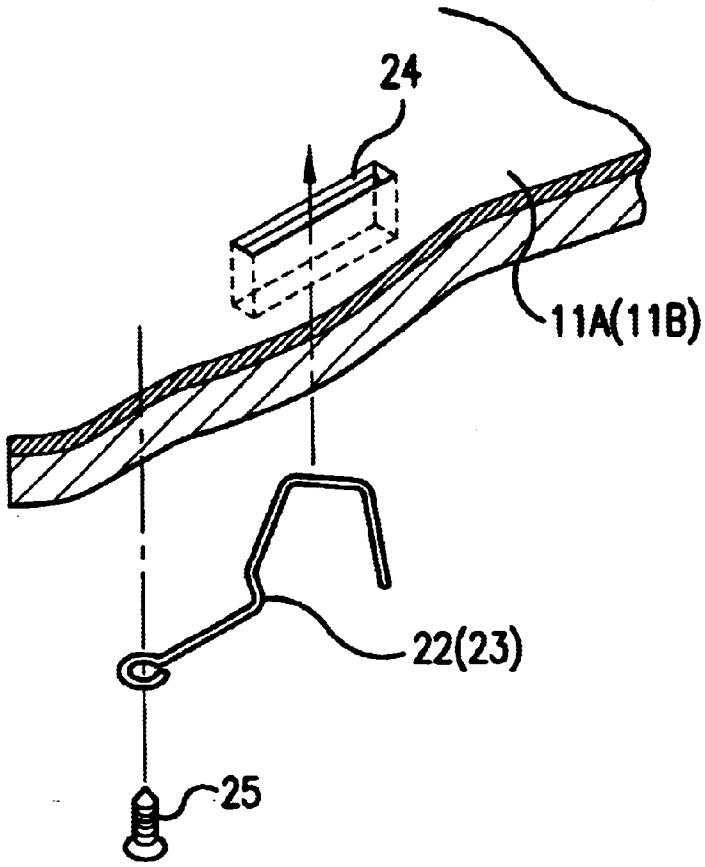
FIG. 9B is an exploded view showing the configuration of the spring member before mounting.

As shown in FIG. 8, the rotatable turn table 11 comprises a circular flat portion 11A and an inclining portion 11B enclosing around the circular flat portion 11A. A width of the inclining portion 11*b* is set to be approximately as wide as the width of a piece in order to secure stability of the pieces at the time of rotation of the pieces. A top face of the rotatable turn table 11 may be covered with a cross sheet, known to the art, in order to provide an appropriate level of smoothness. The circular flat portion 11A and the surrounding inclining portion 11B of the rotatable turn table 11 are each provided with spring members 22 and 23, respectively, at an appropriate peripheral interval, in order to prevent the pieces 4 from standing upright on its one side or superimposing over another piece and to secure a smooth transferal of the pieces 4. FIG. 9A shows the configuration of the spring member 22 (23) after mounting and FIG. 9B shows the configuration thereof before mounting. As shown in FIG. 9B, the spring member 22 (23) is configured such that its one end portion is in a hook-shaped form and its other end portion is in the form of a small circle. The spring member 22 and 23 are mounted on the circular flat portion 11A and the surrounding inclining portion 11B of the rotatable turn table 11, respectively, by inserting the hook-shaped portion of each spring member from outside into and through a slit 24 so as for a part of the hook-shaped portion thereof to protrude inside therefrom, as shown in FIG. 9A, the slit 24 being each provided in the circular flat portion 11A and the surrounding inclining portion 11B thereof. The spring members 22 and 23 are secured to the respective back sides of the circular flat portion 11A and the surrounding inclining portion 11B of the rotatable turn table 11 by means of a vise 25 by inserting the vise through the circle portion of each spring member and screwing it into the back side of the circular flat portion 11A.

Figure 10:
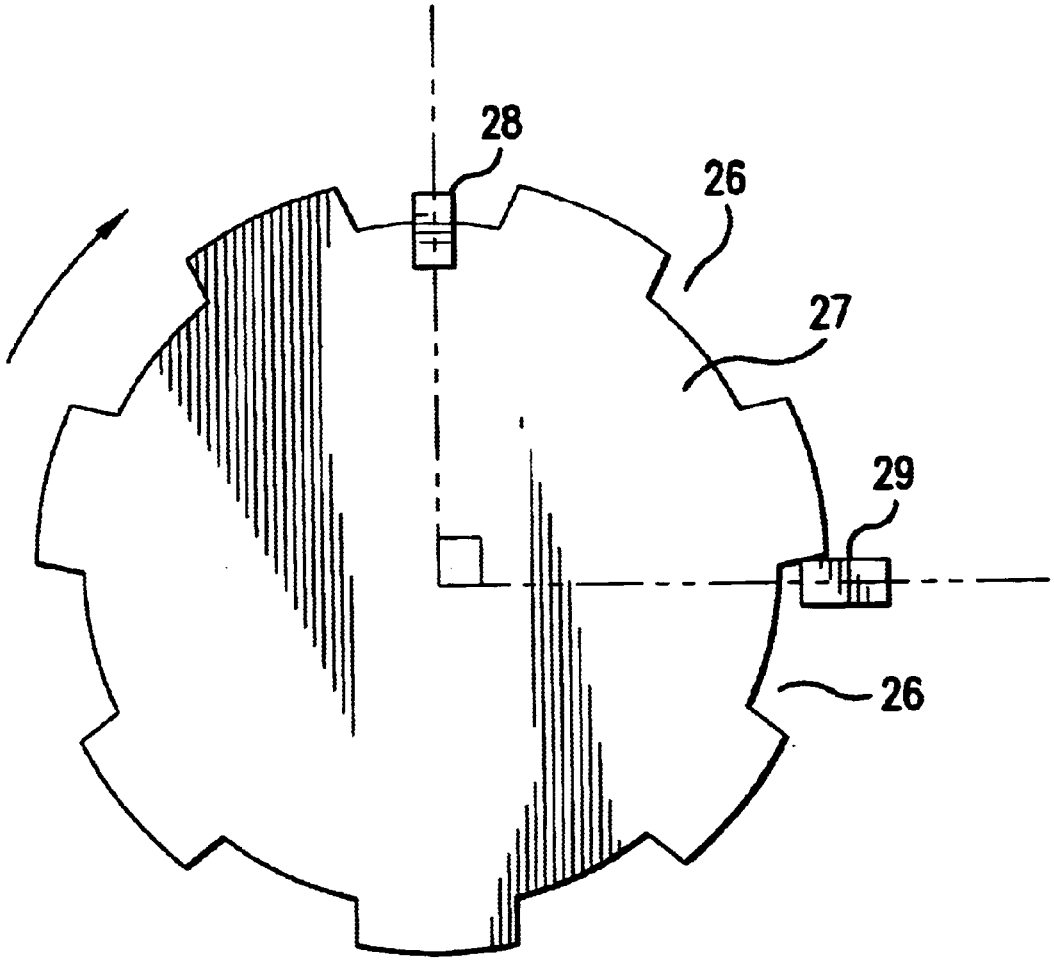
FIG. 10 is a view explaining a circular metal plate and sensors.

As shown in FIG. 10, a circular metal plate 27 is secured to the back side of the rotatable turn table 11, the circular metal plate 27 being provided with a plurality of cut-away portions 26 on its outer periphery at a constant interval. Further, sensors 28 and 29 are mounted at an angle of 90° in order to sense the presence and absence of the cut-away portions at the outer periphery of the circular metal plate 21.

As shown in FIGS. 6 and 7, the peripheral wall 12 defining and enclosing the outer periphery of the rotatable turn table 11 is secured to the mounting base 15 by means of a plurality of mounting members 30 to define and restrict the outward movement of the pieces. The peripheral wall 12 and the inclining portion 11B of the rotatable turn table 11 constitute a piece passage 31 along which the pieces are transferred.

As specifically shown in FIG. 7, slits 32 and 33 are formed in the peripheral wall 12. The slit 32 is located at a portion at which the rotatable turn table 11 reaches the highest position and the slit 33 is located at a portion thereof ahead of the highest portion thereof. A propeller member 34 is disposed so as for its portion to be inserted into and through the slit 32 and protrude therefrom and a propeller member 35 is disposed so as for its portion to be inserted into and through the slit 33 and protrude therefrom. The propeller member 34 is connected to a step motor 37 through an output shaft 38 and the propeller member 35 is connected to a step motor 40 through an output shaft 41. The step motor 37 is mounted on a support frame 36 that in turn is secured to the mounting base 15. The step motor 40 is likewise mounted on a support frame 39 that in turn is secured to the mounting base 15. The dimension of the propeller member 34 is set to be larger than that of the propeller member 35. The direction of rotation of the propeller member 34 is set to be clockwise and the direction of rotation of the propeller member 35 is set to be counterclockwise.

Figure 11:
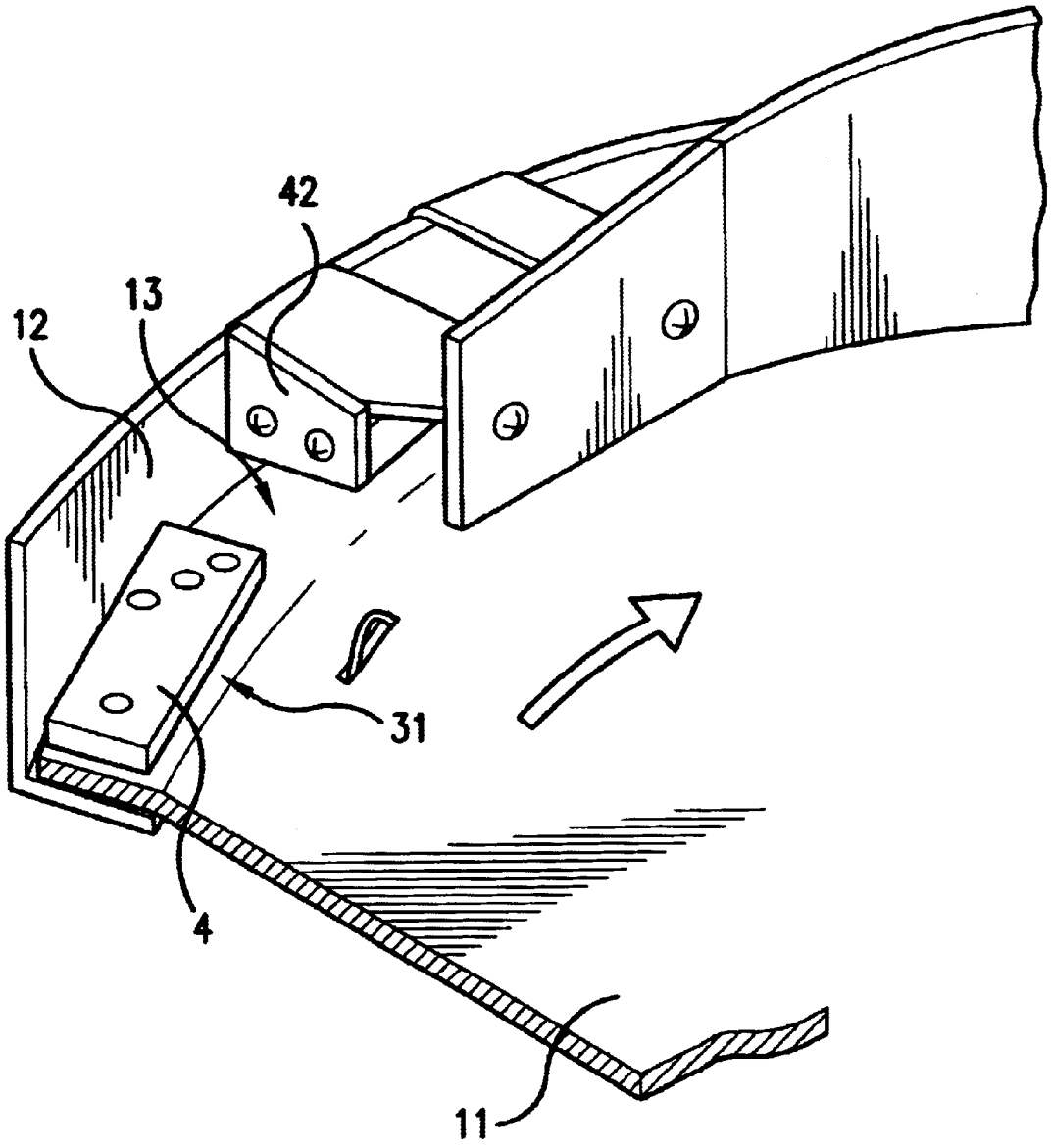
FIG. 11 is a view explaining a piece inlet port.

At the terminal end of the piece passage 31 is disposed the piece outlet port 13 that leads the piece 4 toward the pieces guide passage, as shown in FIG. 11. The piece outlet port 13 comprises the inclining portion 11B of the rotatable turn table 11 and a clearance defining member 42 that is disposed so as to provide a clearance somewhat wider than the width of each piece 4.

Then, a description will be given regarding the action of the pieces-mixing and arranging mechanism A.

Figure 12:
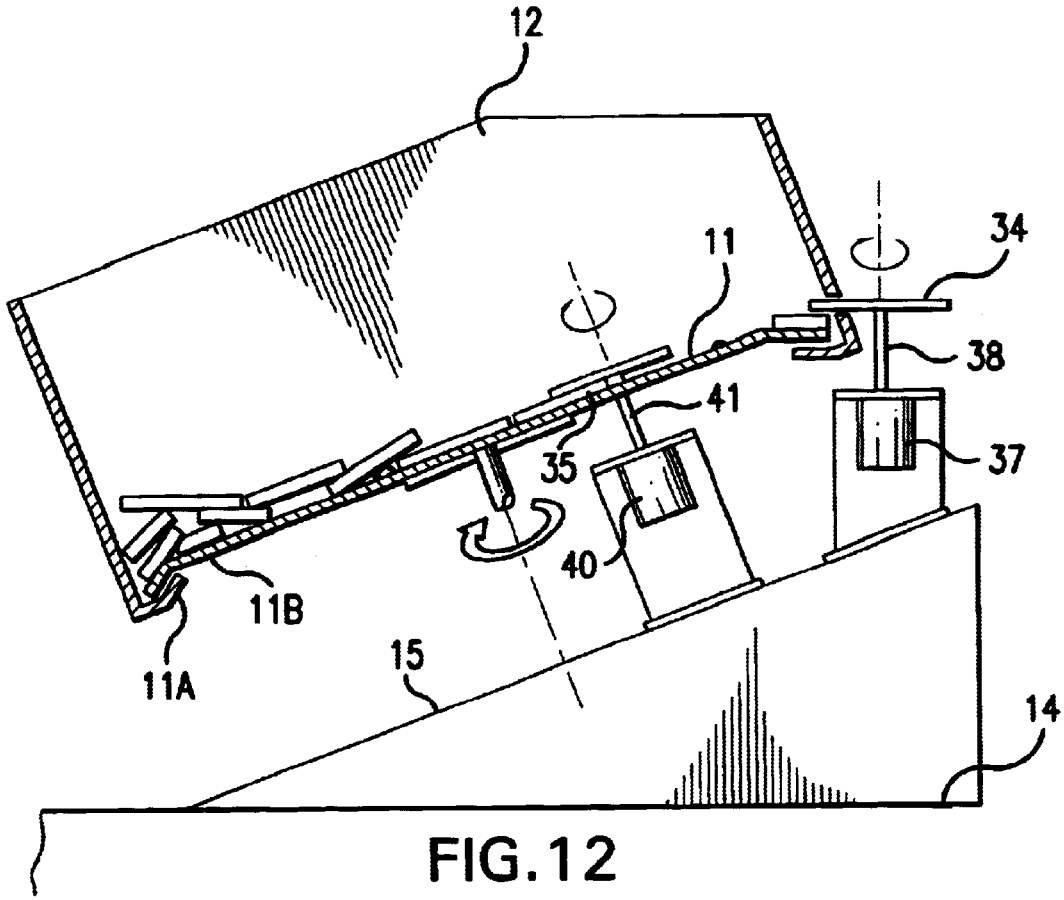
FIG. 12 is a view explaining a state of pieces discharged onto the turn table.
Figure 13:
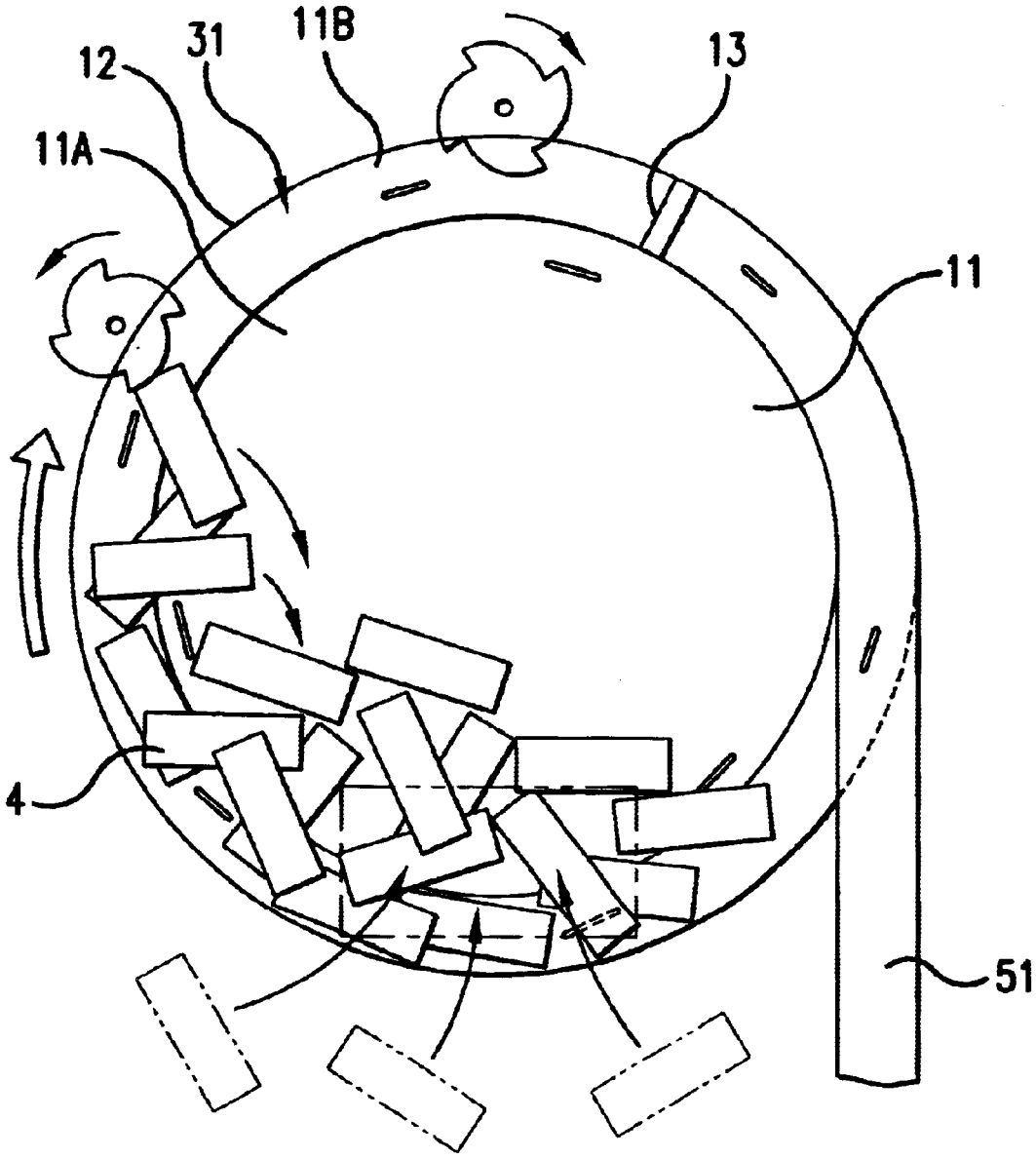
FIG. 13 is a view showing the state in which the pieces gather in a lower position of the turn table disposed in an inclining fashion.
Figure 14:
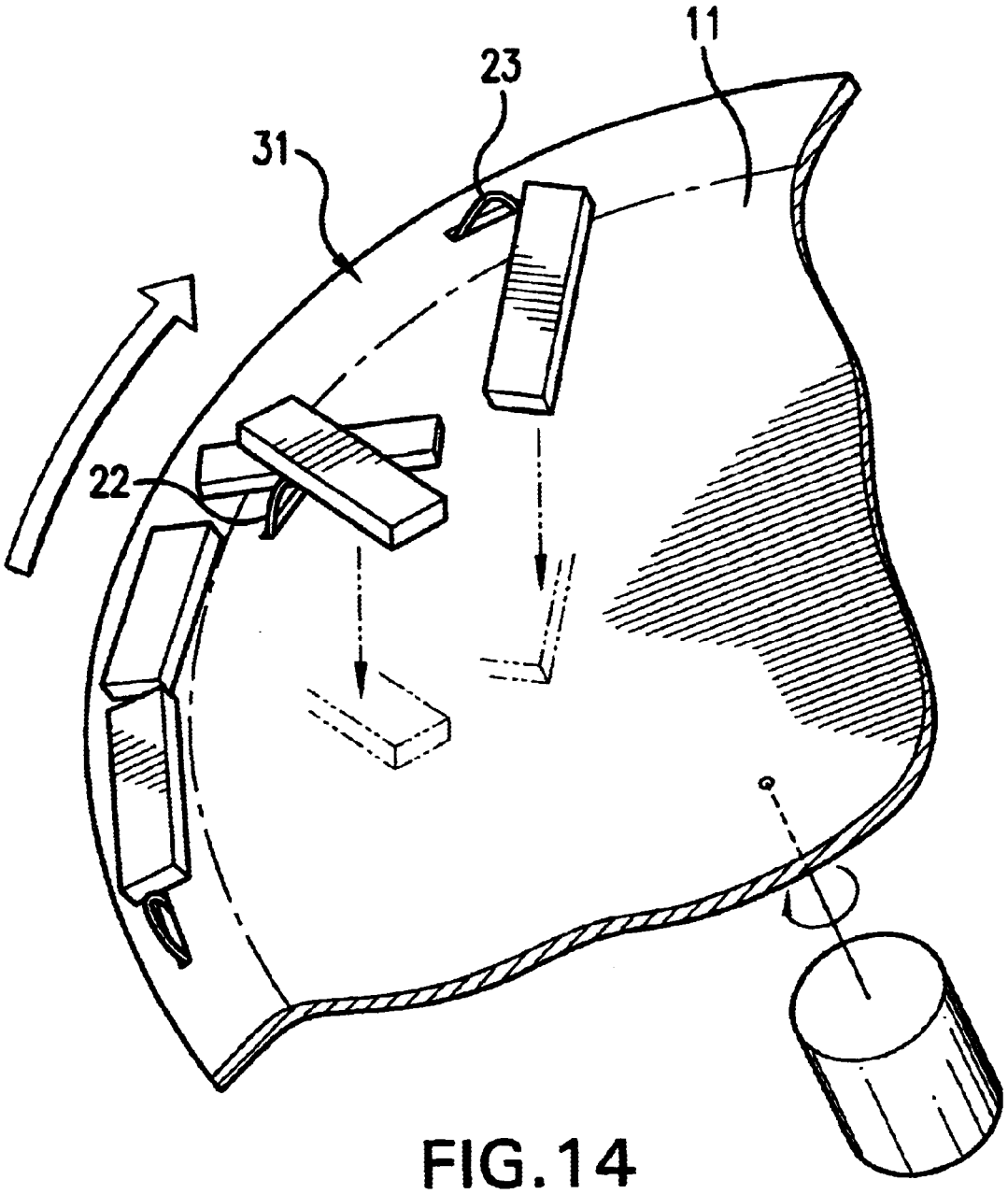
FIG. 14 is a view showing the state in which the pieces are being transferred upward.
Figure 15:
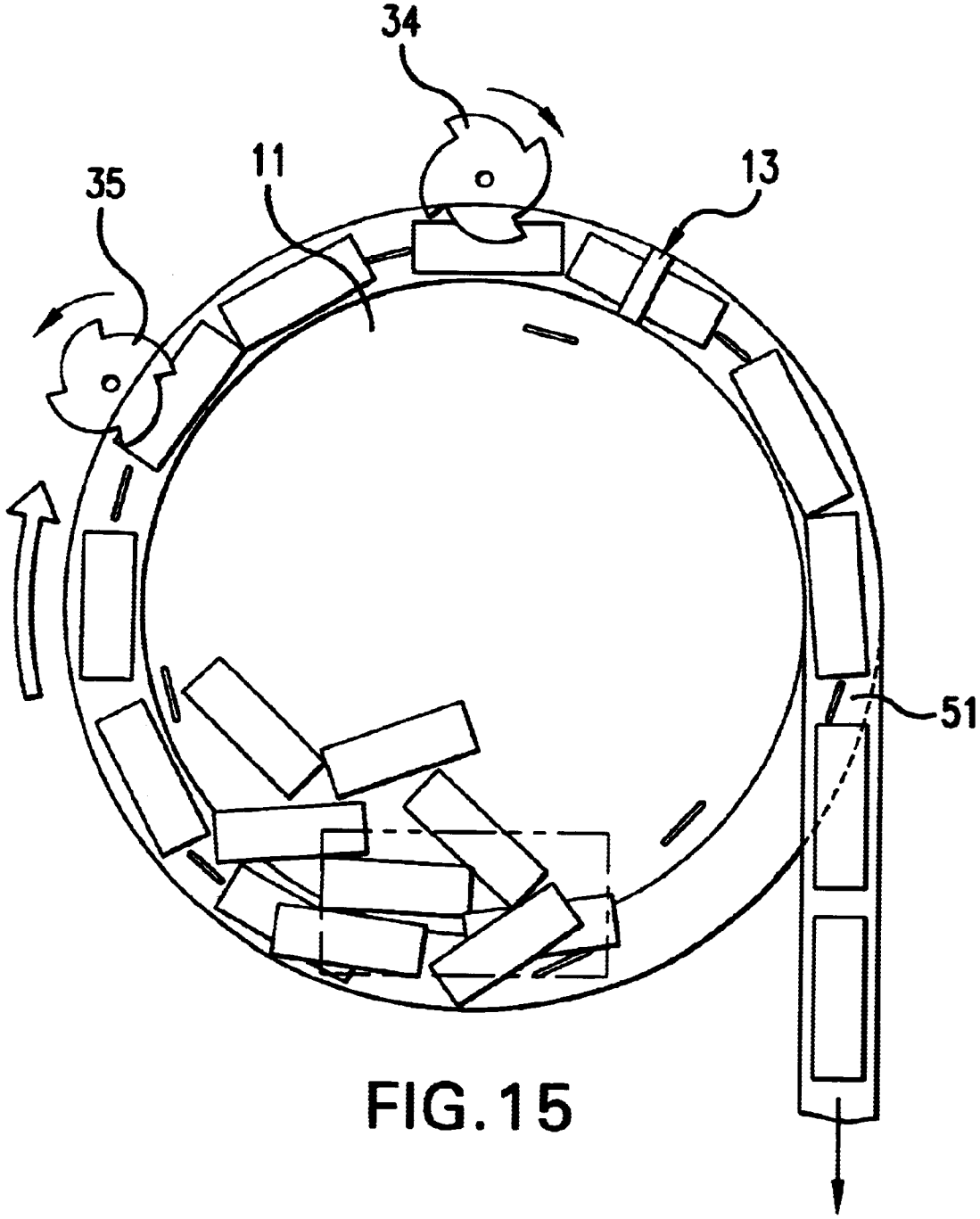
FIG. 15 is a view showing the manner in which the pieces are transferred one by one into a piece guide passage from the turn table.

Once one game was over, a set of the pieces 4 used for that game is discharged from the piece outlet port 6 into the main apparatus body 7 and all the pieces 4 are cast into the rotatable turn table 11. Then, the rotatable turn table 11 is operated such that it is rotated in a clockwise direction at a constant angular speed by starting rotating the step motor 19 by means of an automatic operation or a manual switch operation, transmitting the drive force of the step motor to a drive shaft 16 via the output shaft 20 and the gears 21 and 18, and rotating the drive shaft 16 by means of the drive force transmitted from the step motor. As the pieces 4 were cast into the rotatable turn table 11, a majority of the pieces 4 gather together on the lower side of the rotatable turn table 11 due to the inclining disposition of the rotatable turn table 11, as shown in FIGS. 12 and 13. As the rotatable turn table 11 starts rotating after the pieces 4 were cast thereinto, the pieces 4 gathered regularly along the inclining portion 11B of the rotatable turn table 11 are transferred upwardly while dropping the pieces 4 placed irregularly toward the bottom of the rotatable turn table 11 due to gravity, as shown in FIG. 14. As this action is continued, all the pieces 4 can be transferred to the piece outlet port 13 and discharged one by one from the piece outlet port 13 toward the pieces guide passage 51. As all the pieces 4 were discharged into the pieces guide passage 51 from the turn table 11, the rotation of the rotatable turn table 11 is suspended.

Figure 16:
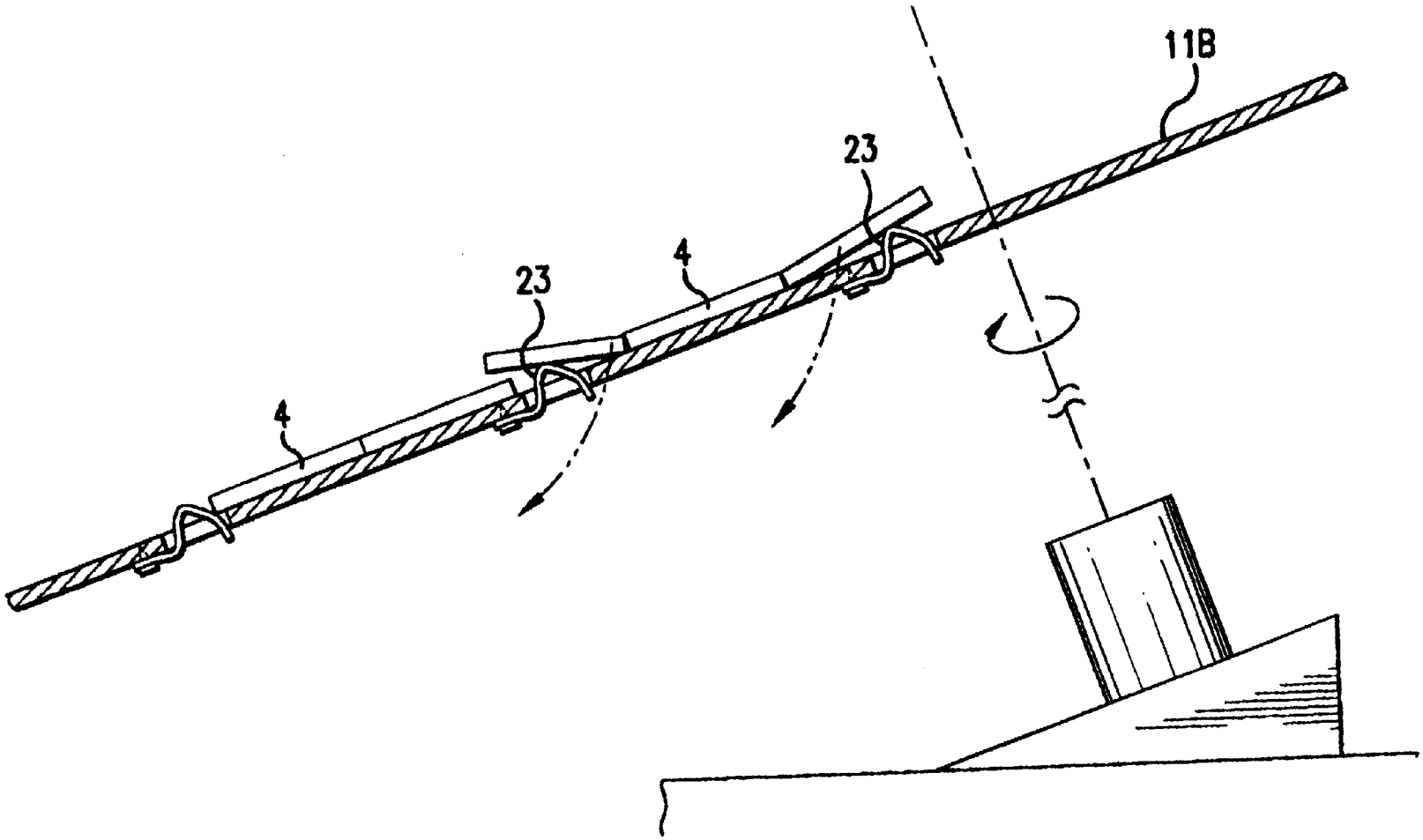
FIG. 16 is a view explaining the action of a spring member.
Figure 17A:
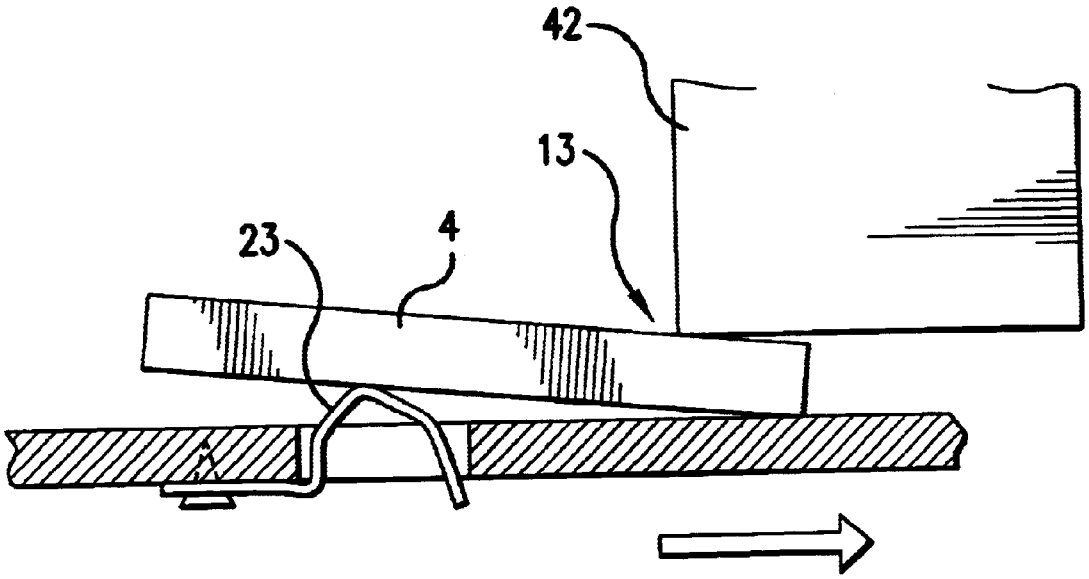
FIG. 17A is a view explaining the action of a spring member.
Figure 17B:
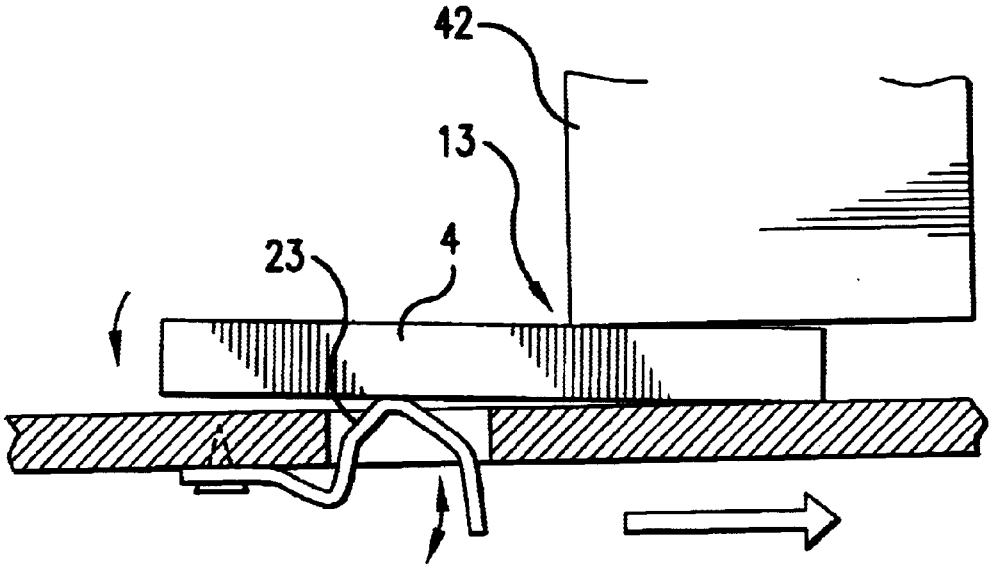
FIG. 17B is a view explaining the action of the spring member.

As a plurality of the spring members 22 and 23 are provided on the surface of the rotatable turn table 11, each of the spring members is arranged so as to act as a hook to hold each of the pieces 4, as shown in FIG. 16, enabling a smooth guide of the pieces 4 toward the piece outlet port 13. The spring members 22 and 23 can smoothly drop the pieces 4 that are located in an irregular fashion and facilitates a smooth arrangement of the dropped pieces 4 so as to guide them to the piece outlet port 13. Moreover, as shown in FIGS. 17A and 17E, the spring member 23 is disposed so as to pull back into the slit 24 so that the clogging of the piece outlet port 13 with the piece 4 can be avoided.

Figure 18A:
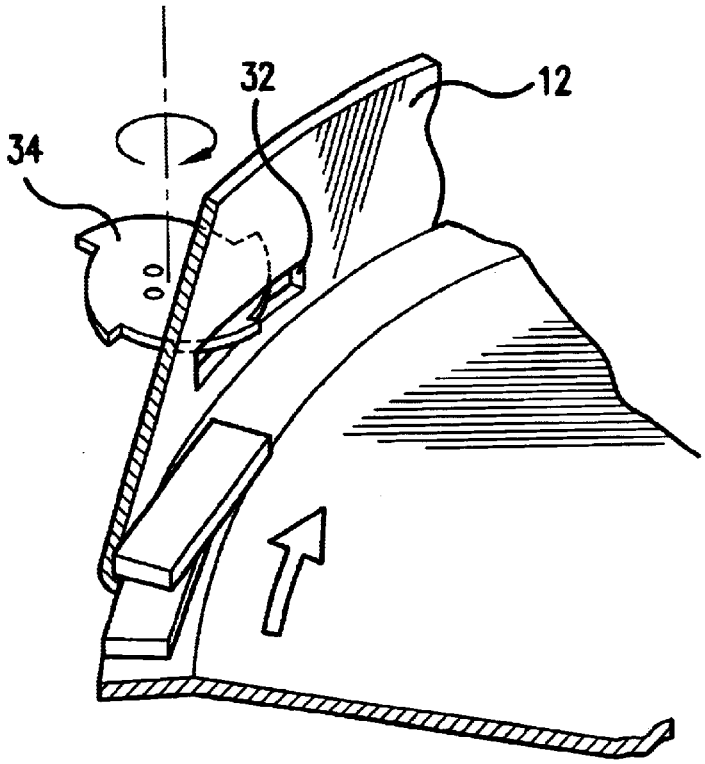
FIG. 18A is a view explaining the action of a propeller member.
Figure 18B:
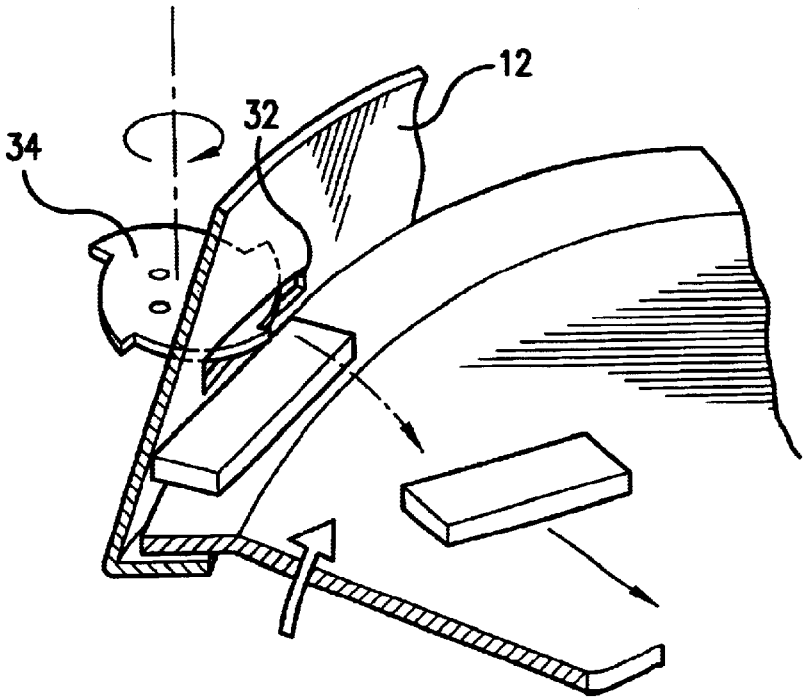
FIG. 18B is a view explaining the action of the propeller member.

Moreover, the piece passage 31 is provided with the propeller members 34 and 35. The propeller member 35 can act as facilitating the transferal of the pieces 4 toward the piece outlet port 13, and the propeller member 34 can act as effectively blocking the pieces 4 from standing upright or superimposing over another piece (see FIGS. 18A and 18B).

The action of rotation of the rotatable turn table 11 is monitored with sensors 28 and 29 in the course of the above action. If it is sensed that the rotation of the rotatable turn table 11 has been suspended for a predetermined period of time, the control unit determines that the clogging of the pieces 4 occurs and allows the step motor 19 to turn in a reverse direction to unclog the piece out port. Once the pieces 4 were removed and unclogged, the rotatable turn table 11 is again rotated in a normal direction.

Pieces-determining and Turning Mechanism B

For playing a Pai Goi game with pieces, first, a set of the pieces 4 has to be arranged on the playing table 2 with the plain faces of the pieces directed upward while the marked faces thereof are hidden.

The pieces-determining and turning mechanism B is a mechanism that determines the plain faces and the marked faces of the pieces 4 transferred one after another from the rotatable turn table 11 and that reverse the face of the piece if the marked face thereof is directed upward and that allows the passage of the piece as it is if the plain face thereof is directed upward.

Figure 19:
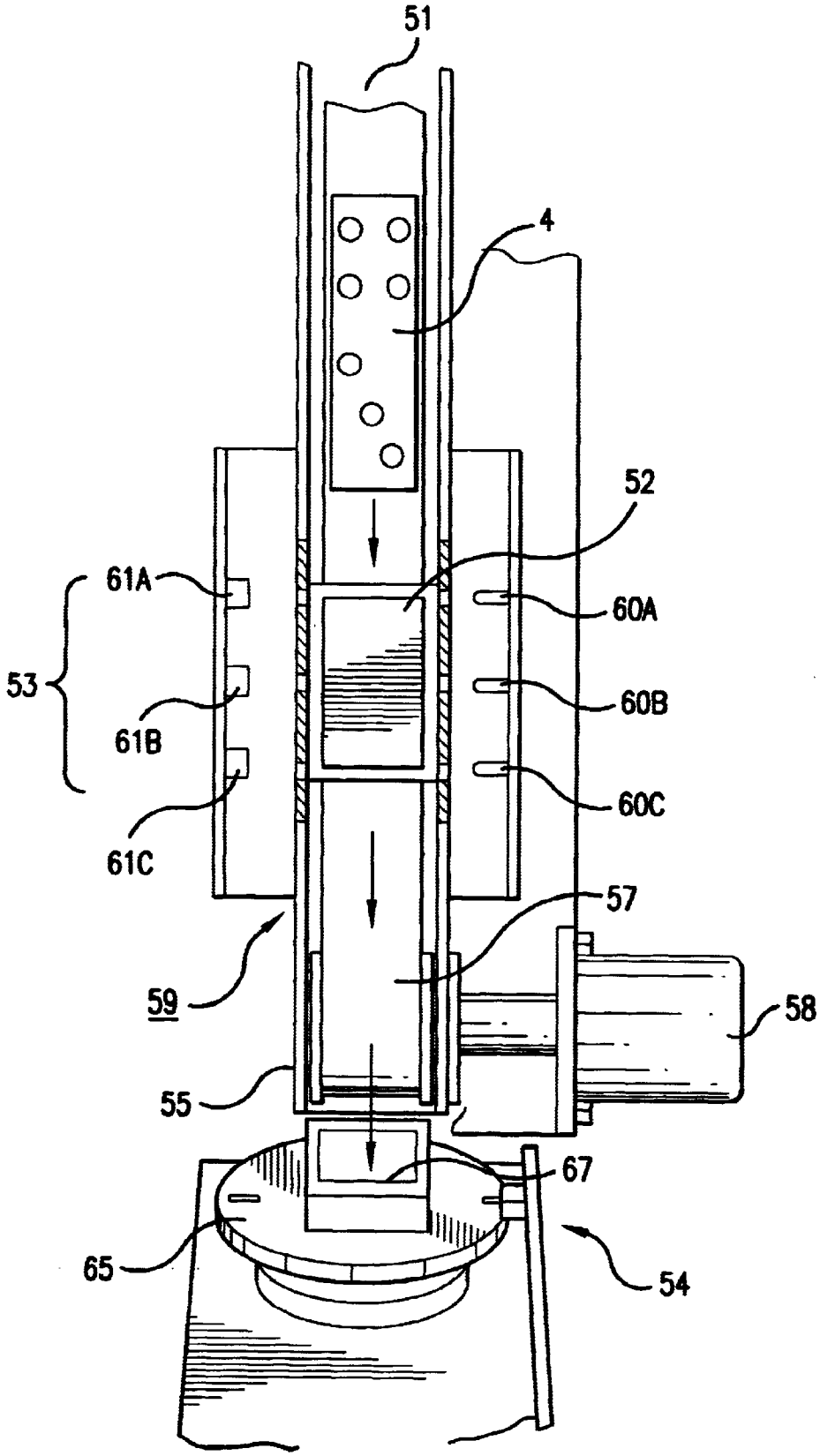
FIG. 19 is a plan view showing the configuration of a face-determining and turning mechanism.

As shown in FIG. 19, the pieces-determining and turning mechanism 8 comprises the pieces guide passage 51, a face-sensing sensor 52, a group of position sensors 53, and a face-reversing mechanism 54.

Figure 20:
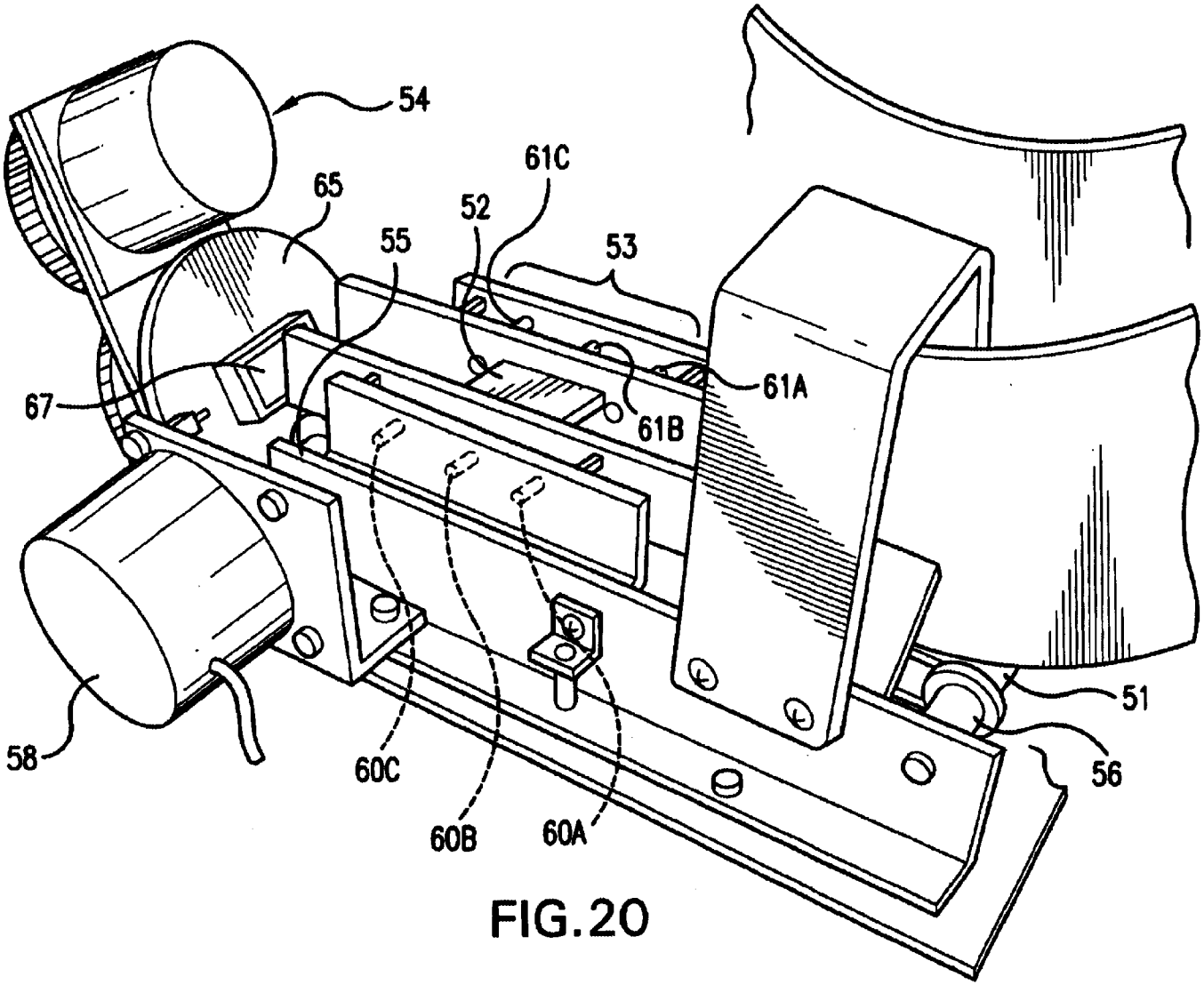
FIG. 20 is a perspective view showing the configuration of the face-determining and turning mechanism.

The pieces guide passage 51 corresponds to a passage extending from the piece outlet port 13 to the face-reversing mechanism 54, as shown in FIG. 5. The pieces guide passage 51 serves as transferring the pieces 4 one after another from the piece outlet port 13 to the face-reversing mechanism 54, in cooperation with a pieces-conveying mechanism 59. As shown in FIGS. 19 and 20, the pieces-conveying mechanism 59 comprises a pair of pulleys 55 and 56, an endless belt 57, and a step motor 58 for driving the pulley 55, and it is disposed on the downstream side of the piece outlet port 13. The endless belt 57 may be preferably provided with tension.

The face-sensing sensor 52 is a sensor capable of optically sensing the top face and the bottom face of a piece. Such a sensor may include, for example, an infrared sensor. In order to allow an optical detection by the face-sensing sensor 52 installed in this apparatus, the pieces 4 for use with this apparatus may be coated on their top faces with a paint or any other material that can be sensed by the face-sensing sensor 52. Cards for conventional use cannot be used for the apparatus according to the present invention.

As shown in FIGS. 19 and 20, a group of position sensors 53 comprises three sets of position sensors (60A and 61A; 60B and 61B; 60C and 61C) in the embodiment of the present invention. Each of the position sensors 60A, 60B and 60C comprises an infrared emission element, and each of the position sensors 61A, 61B and 61C comprise a light recipient element. The first sensors 60A and 61B are disposed to sense the arrival of a piece. The second sensors 60B end 61B are disposed so as to determine whether the determination of the top faces and the bottom faces of the pieces 4 by the face-sensing sensor 52 is correct or not. The third sensors 60C and 61C are disposed to determine whether or not the piece is to be transferred to the face-reversing mechanism 54. The information of detection by the position sensors and the information of determination by the face-sensing sensor 52 are transmitted to the control unit (not shown). The control unit controls the actions of the rotatable turn table 11 on the basis of these information, the actions including, for example, a temporary suspension of the rotation of the rotatable turn table 11, determination of the faces of the piece, a resumption of the rotation of the rotatable turn table 11, and so on.

Figure 21:
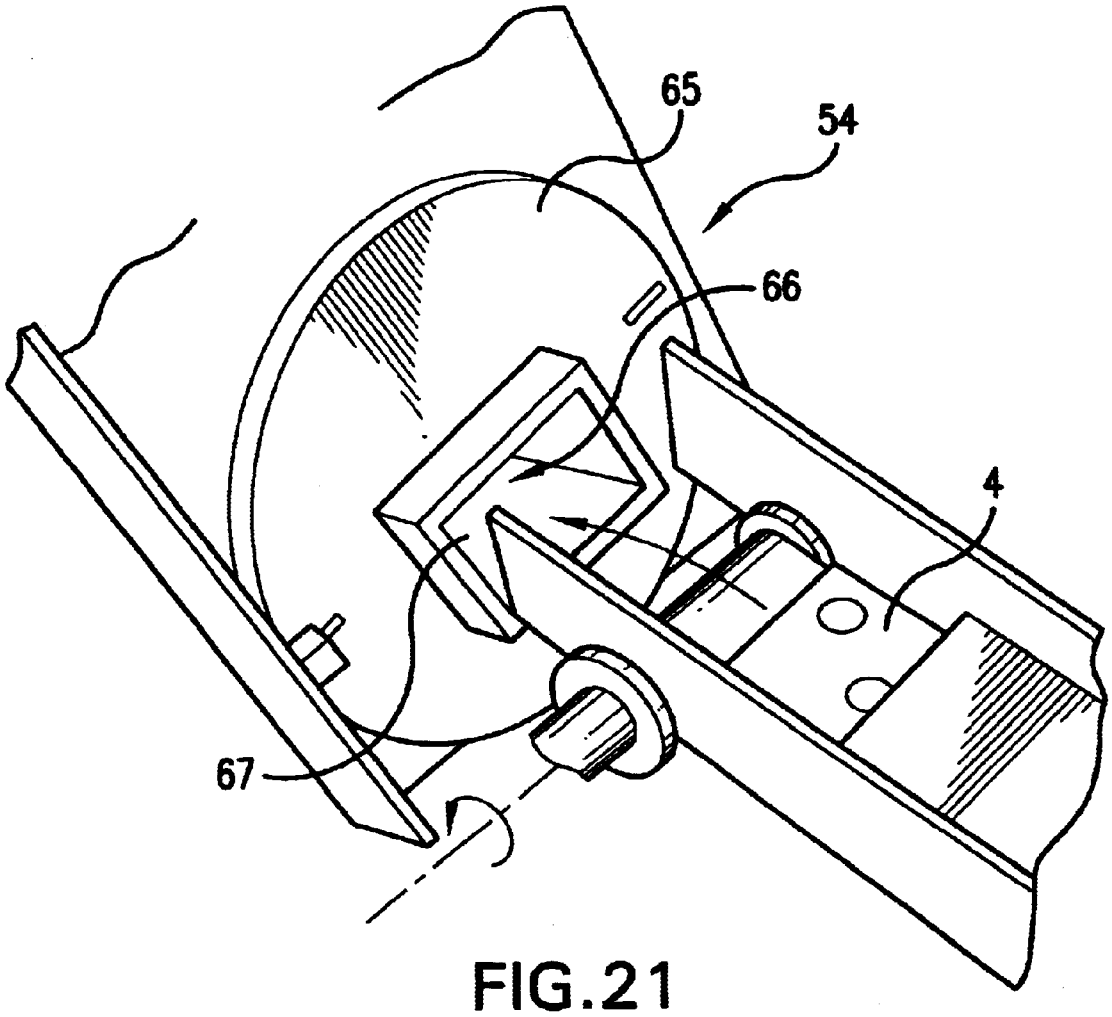
FIG. 21 is a perspective view showing the configuration of a face-reversing mechanism.
Figure 22:
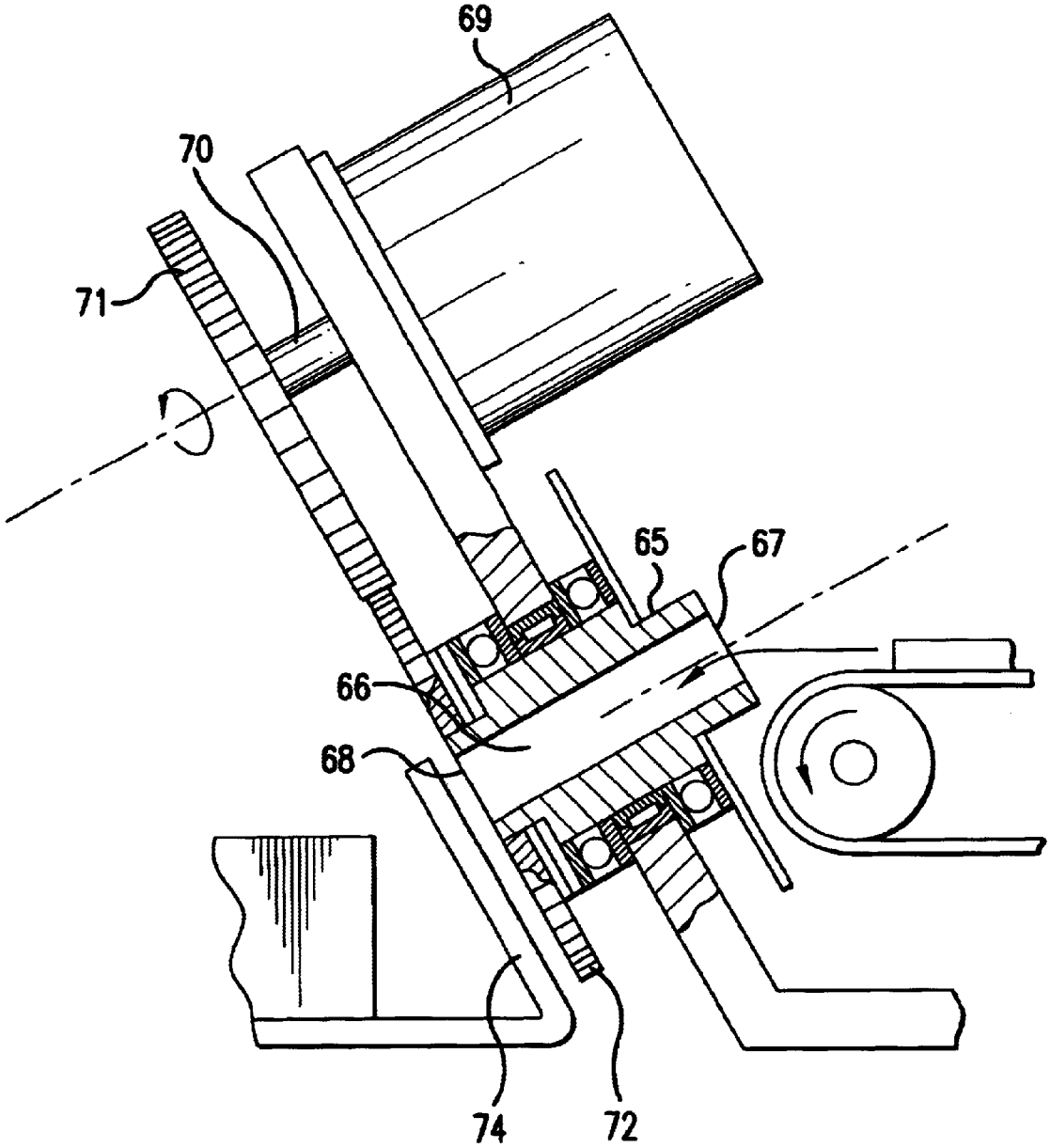
FIG. 22 is a side view showing the configuration of the turning mechanism.
Figure 23:
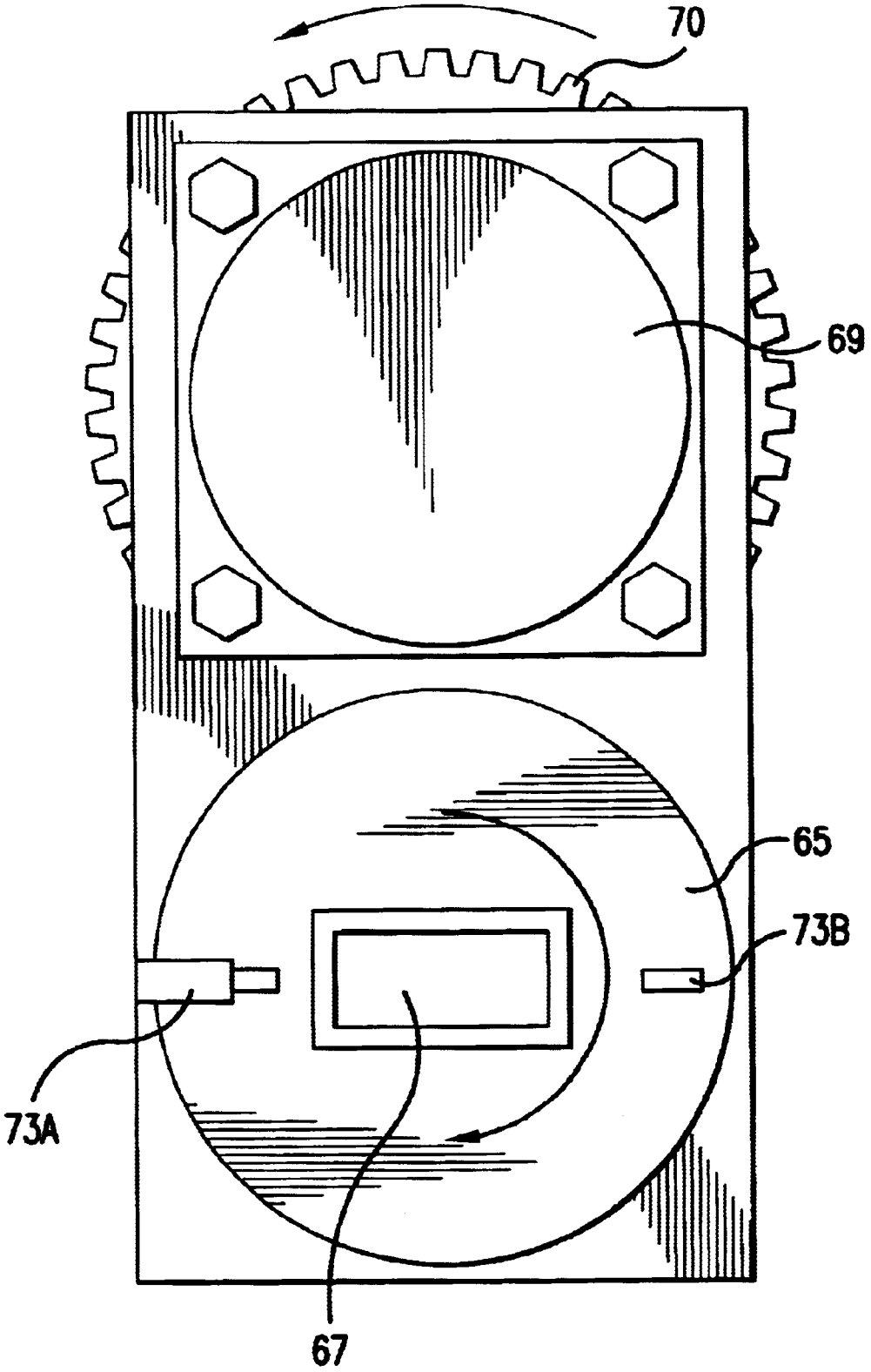
FIG. 23 is a front view showing the configuration of the face-reversing mechanism.
Figure 24A:
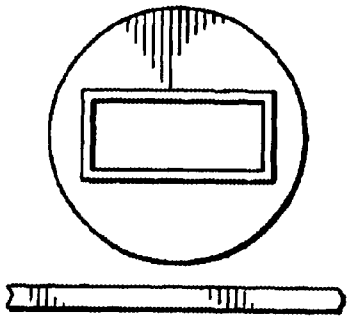
FIG. 24A is a view explaining the action of the face-reversing mechanism.
Figure 24B:
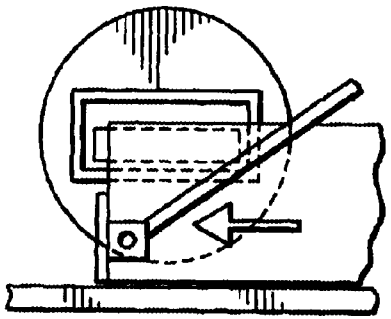
FIG. 24B is a view explaining the action of the face-reversing mechanism.
Figure 24C:
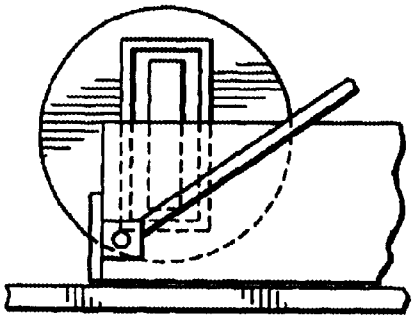
FIG. 24C is a view explaining the action of the face-reversing mechanism.
Figure 24D:
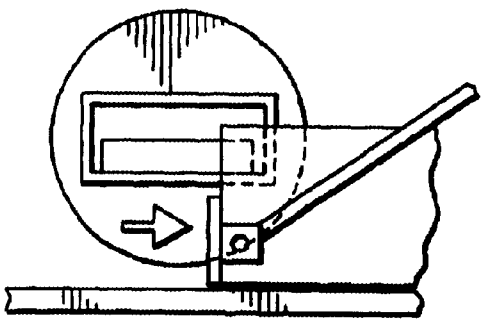
FIG. 24D is a view explaining the action of the face-reversing mechanism.
Figure 24E:
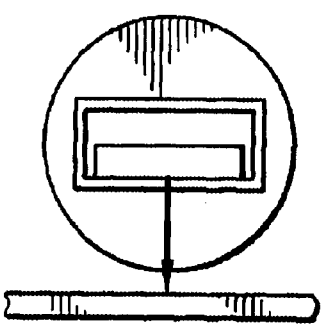
FIG. 24E is a view explaining the action of the face-reversing mechanism.
Figure 24F:
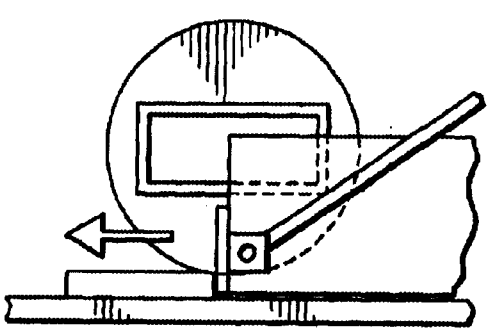
FIG. 24F is a view explaining the action of the face-reversing mechanism.
Figure 25:
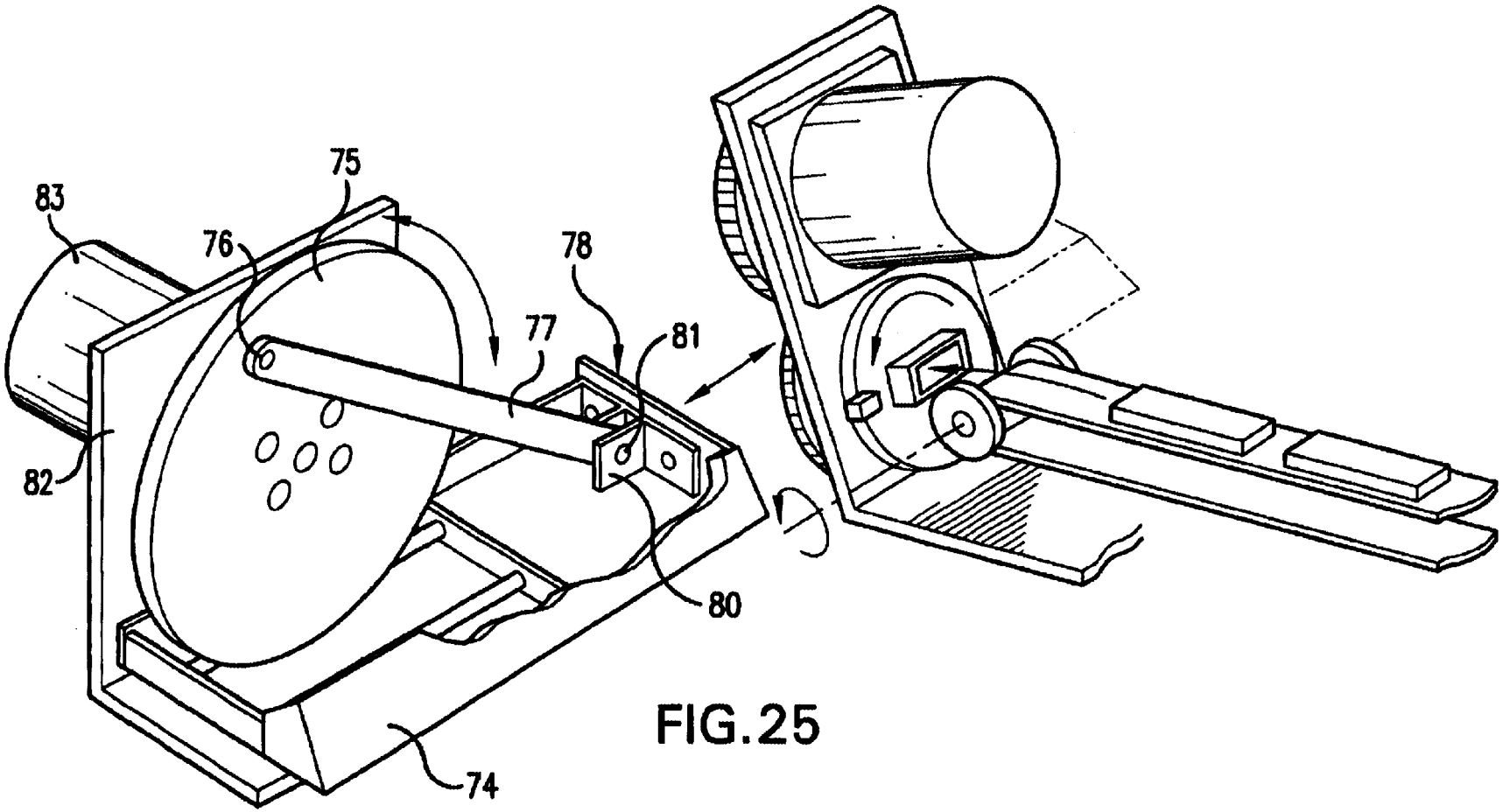
FIG. 25 is a perspective view showing the configuration of a piece-pushing and arranging mechanism.

As shown in FIGS. 21 (a perspective view), 22 (a side view) and 23 (a front view), the face-reversing mechanism 54 has a face-reversing device 65 that in turn is provided inside with a piece-accommodating portion 66 for accommodating the piece so as to allow the face of the piece can be reversed. The piece-accommodating portion 66 has a piece outlet port 61 on its front side and a piece outlet port 68 on its back side. As shown in FIG. 22, a step motor 69 is provided which has an output shaft 70 whose one end is mounted on a gear 71. A gear 72 is mounted on the side of the face-reversing device 65. The gear 71 is in mesh with the gear 72. As shown in FIG. 23, optical sensors 73A and 73B are disposed on the front side of the face-reversing device 65 in order to optically detect the position of rotation of the face-reversing device 65. A holding plate 74 is disposed in the vicinity of the piece outlet port 68 of the piece-accommodating portion 66 so as to be movable between the position of holding the piece and the position of non-holding the piece.

Then, the action of the pieces-determining and turning mechanism B will be described in more detail.

The pieces 4 discharged from the piece outlet port 13 of the rotatable turn table 11 are conveyed one by one along the pieces guide passage 51 up to the pieces-conveying mechanism 59. For the pieces-conveying mechanism 59, the step motor 58 is driven by the control of the control unit (not shown), the driving force is transmitted to the pulley 55 and the belt 57 is driven for forward movement. The pieces are conveyed one by one on the belt 57 and, as the piece arrived at the first position sensors 60A and 61A, signals are detected by the first position sensors 60A and 61A and the detected signals are transmitted to the control unit to suspend the rotation of the rotatable turn table 11 in order for no new piece to come to the first position sensors 60A and 61A. The piece is then conveyed on the belt 57 to the second position sensors 60B and 61B. As it arrived at the second position sensors 60B and 61B, signals are detected by the second position sensors 60B and 61B and the detected signals are transmitted to the control unit in order to determine whether the determination by the face-sensing sensor 52 is right or not. As the face-sensing sensor 52 optically detects the top face or the rear face of the piece 4, a signal of detection is sent to the control unit. More specifically, if a face of the piece directed upward is a plain face, a reflectivity becomes lower than the other face. On the other hand, if an upward-directed face of the piece is a marked face, a reflectivity becomes higher than the other face because the marked face is coated with a coating having a reflectivity higher than that of the plain face of the piece. The information on optical detection by the face-sensing sensor 52 is transmitted to the control unit. Then, the control unit determines the plain face or the marked face of the piece on the basis of the information. When it is determined that the plain face of the piece is directed upward, the piece is conveyed to the piece outlet port 67 of the face-reversing device 54 and then transferred via the face-reversing device 54 to the pieces-pushing and arranging mechanism C. At this time, the holding plate 74 (FIG. 22) is located at its non-holding position. Then, the third sensors 60C and 61C detect the passage of the piece and send signals to the control unit, and then the rotation of the rotatable turn table 11 is resumed. On the other hand, when it is determined that the marked face of the piece is directed upward and the plain face thereof is hidden, i.e., the plain face thereof is directed downward, the step motor 69 is driven while the holding plate 74 is transferred to its holding position. The drive force is transmitted from the output shaft 70 of the step motor via the gears 71 and 72 to the face-reversing device 65, and the face-reversing device 65 is rotated at 180°, thereby reversing the face of the piece 4 to cause the plain face of the piece to direct upward. The status of turning the piece 4 is specifically shown in FIGS. 24A through 24F. Thereafter, the piece 4 is conveyed to the pieces-pushing and arranging mechanism C after the marked face thereof was directed downward and the plain face thereof was directed upward. As the third sensors 60C and 61C detect the passage of the piece 4, they send the signals indicative of the passage of the piece to the control unit. Then, the control unit resumes the rotation of the rotatable turn table 11. The 180° rotation of the face-reversing device 65 is detected by means of sensors 73A and 73B, and the information on the rotation is sent to the control unit.

In the description of the above embodiment of the present invention, an optical detection means is used for determining the top face and the back face of the piece 4. It is to be noted herein, however, that the means for determining the top face and the back face of the piece 4 is not restricted to such an optical detection means and any other appropriate means including, for example, a magnetic detection means can also be used. If a magnetic detection means is used for determining the top face arid the back face of the piece 4, the piece is coated with a magnetic material such as ferrite, etc. on its top face or its rear face or provided with a layer comprised of or containing a magnetic material or mounted or incorporated with a magnetically detectable member.

Pieces-pushing and Arranging Mechanism C

Figure 26A:
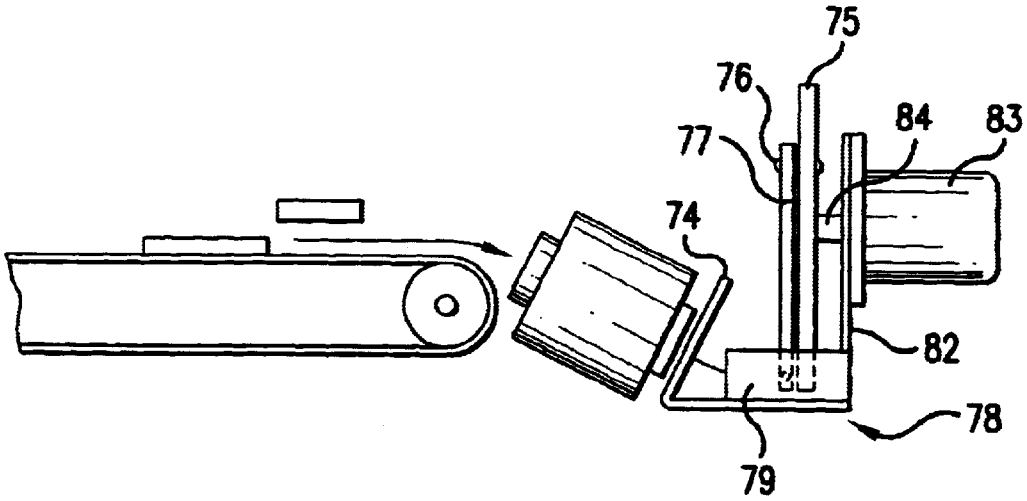
FIG. 26A is a side view explaining the action of the piece-pushing and arranging mechanism.
Figure 26B:
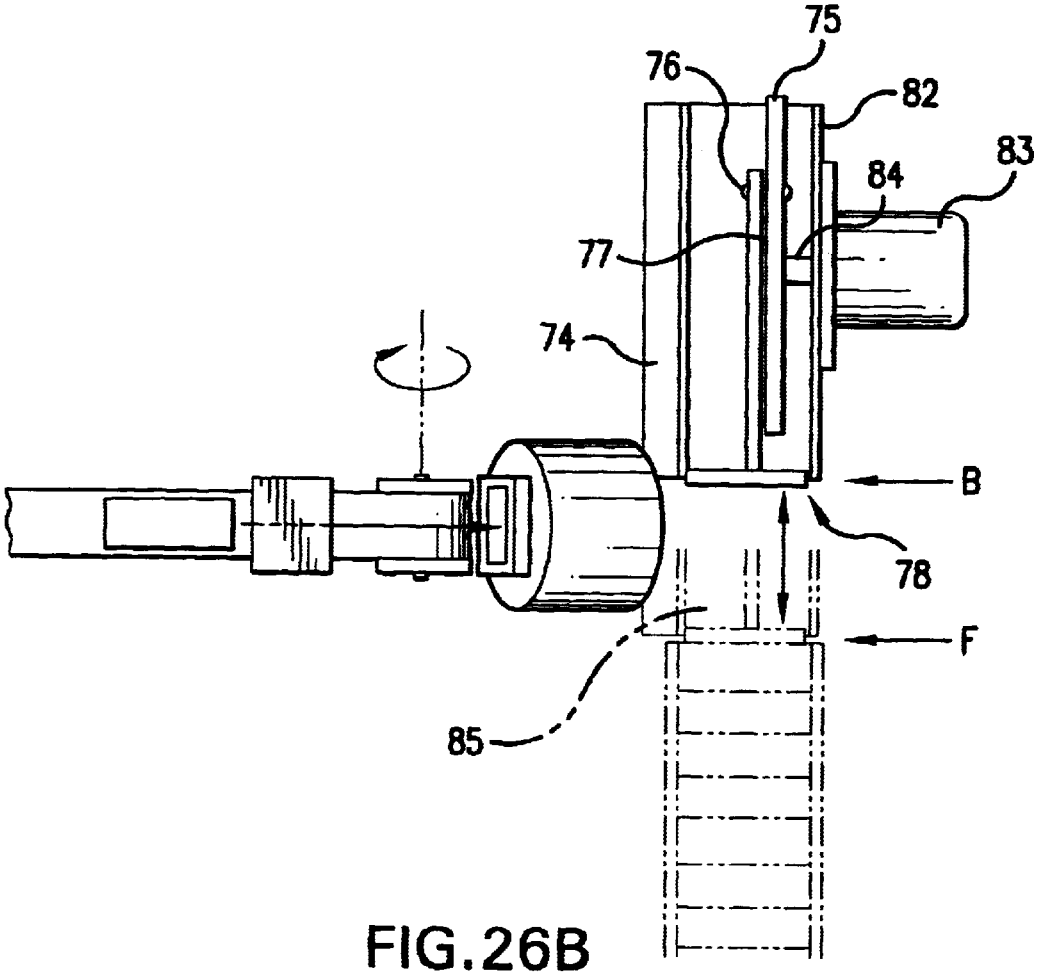
FIG. 26B is a plan view explaining the action of the piece-pushing and arranging mechanism.
Figure 27:
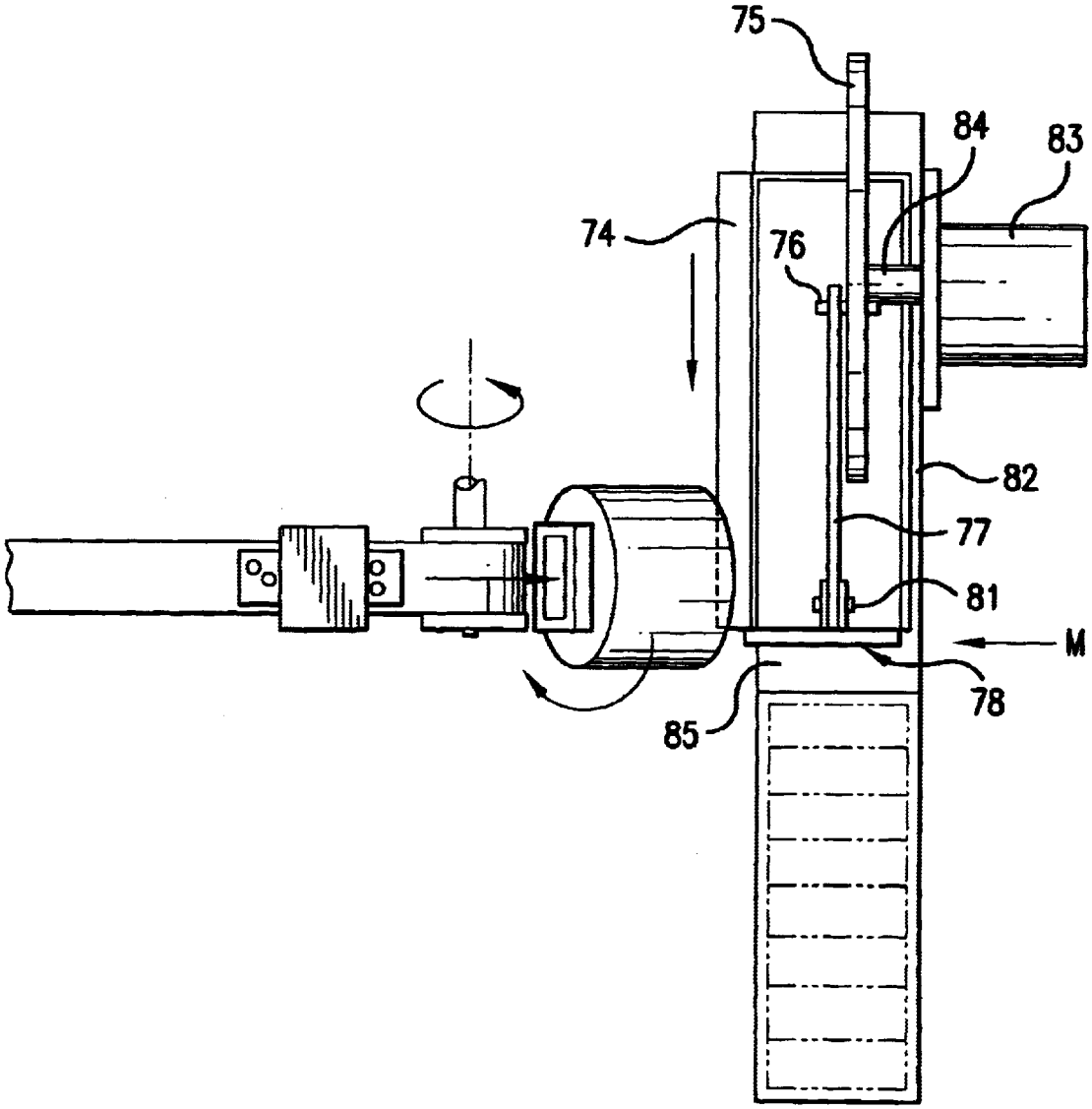
FIG. 27 is a view explaining the action of the piece-pushing and arranging mechanism.

As the pieces 4 are transferred from the pieces-determining and turning mechanism B to the pieces-pushing and arranging mechanism C while staying their plain faces directed upward and their marked faces directed downward as stayed hidden, the pieces-pushing and arranging mechanism C is operated in such a manner that the pieces 4 are pushed one after another to a predetermined location and arranged so as to form a set of 32 pieces, consisting of four rows, each row being composed of eight pieces. The set of the pieces 4 are formed by first arranging eight pieces in a row and secondly overlaying another ray of eight pieces over the first row of eight pieces, thereby eventually forming four rows of the pieces. In this embodiment, the pieces-pushing and arranging mechanism C utilizes a force of a crank shaft for pushing the pieces 4. As shown in FIGS. 25, 26A–B, and 27, a one end of a crank shaft 77 is mounted at an eccentric position of a circular plate 75 as a one fulcrum of an eccentric axis 76, and the other end of the crank shaft 77 is supported by a fixing member 80 mounted on the opposite side of a pushing portion 73 of a piece-pushing member 78. On the other hand, a step motor 83 is mounted on a one surface side of a mounting member 82 and an output shaft 84 is rotatably disposed over and through the entire width of the mounting member 82, while the one end of the output shaft 84 is fixed to a central portion of the circular plate 75. The piece-pushing member 78 is disposed such that it assumes a backward position a and a forward position F, as shown in FIG. 26B, and a middle position M, as shown in FIG. 27, these three positions being all located on a flat piece-pushing and transferring passage 85, by controlling the rotation of the circular plate 75 by means of the control unit. The pushing member 78 is stayed at the backward position B while waiting for a piece being pushed out from the pieces-determining and turning mechanism B. As the piece is pushed out therefrom onto the piece-pushing and transferring passage 85, the piece-pushing member 78 stayed at the backward position B is then pushed forward up to the forward position F while pushing the piece forward. At the middle position M, the piece-holding plate 74 disposed at the position close to the pushing member 18 is disposed so as to hold the piece while the marked face of the piece is being turned upside down. In this embodiment, the holding plate 74 is disposed in association with the pushing member 78. It is to be noted herein, however, that the configuration of the holding plate 74 is not restricted to this particular one and it may be disposed independently therefrom.

Figure 28:
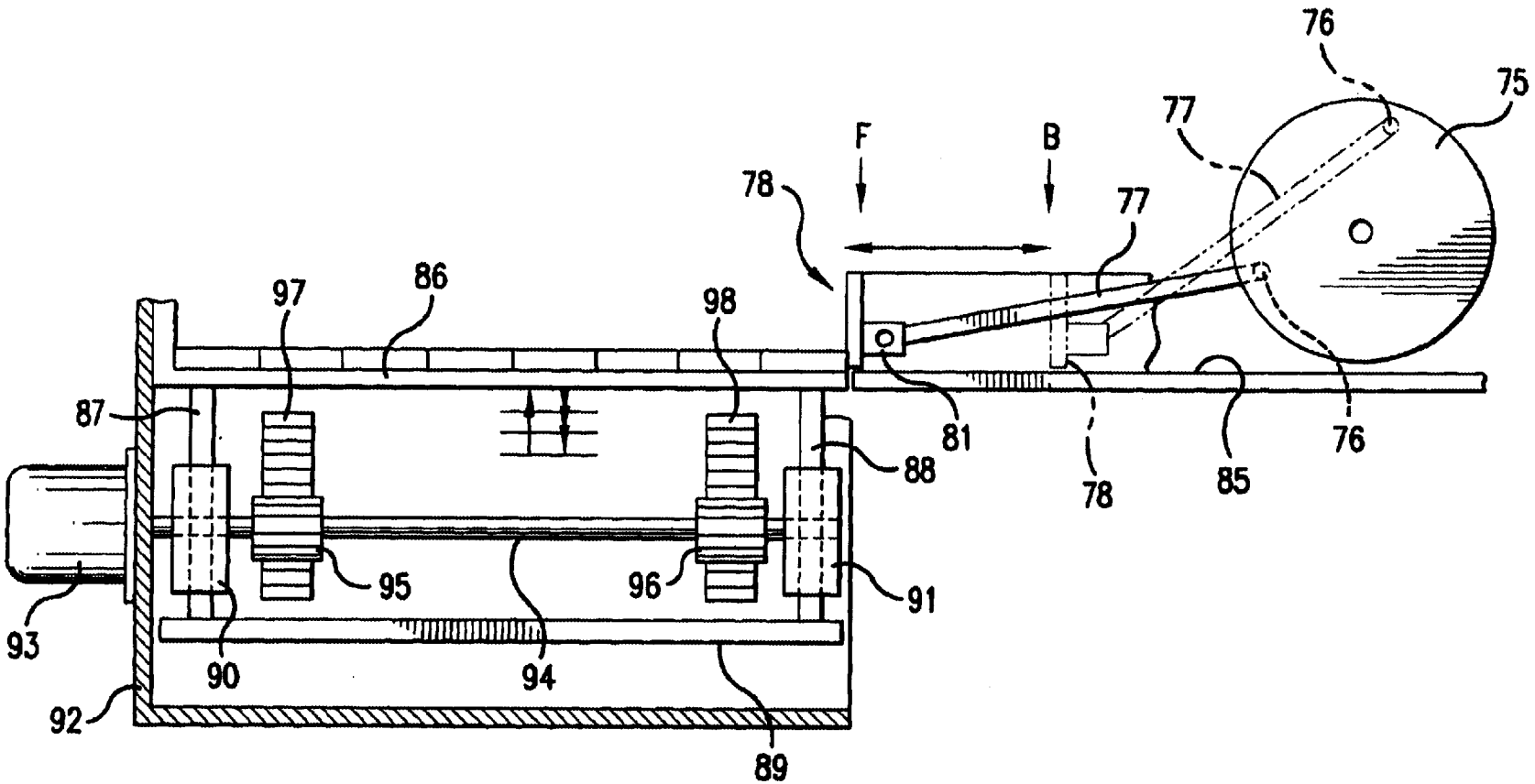
FIG. 28 is a view explaining the configuration of the piece-pushing and arranging mechanism.
Figure 29:
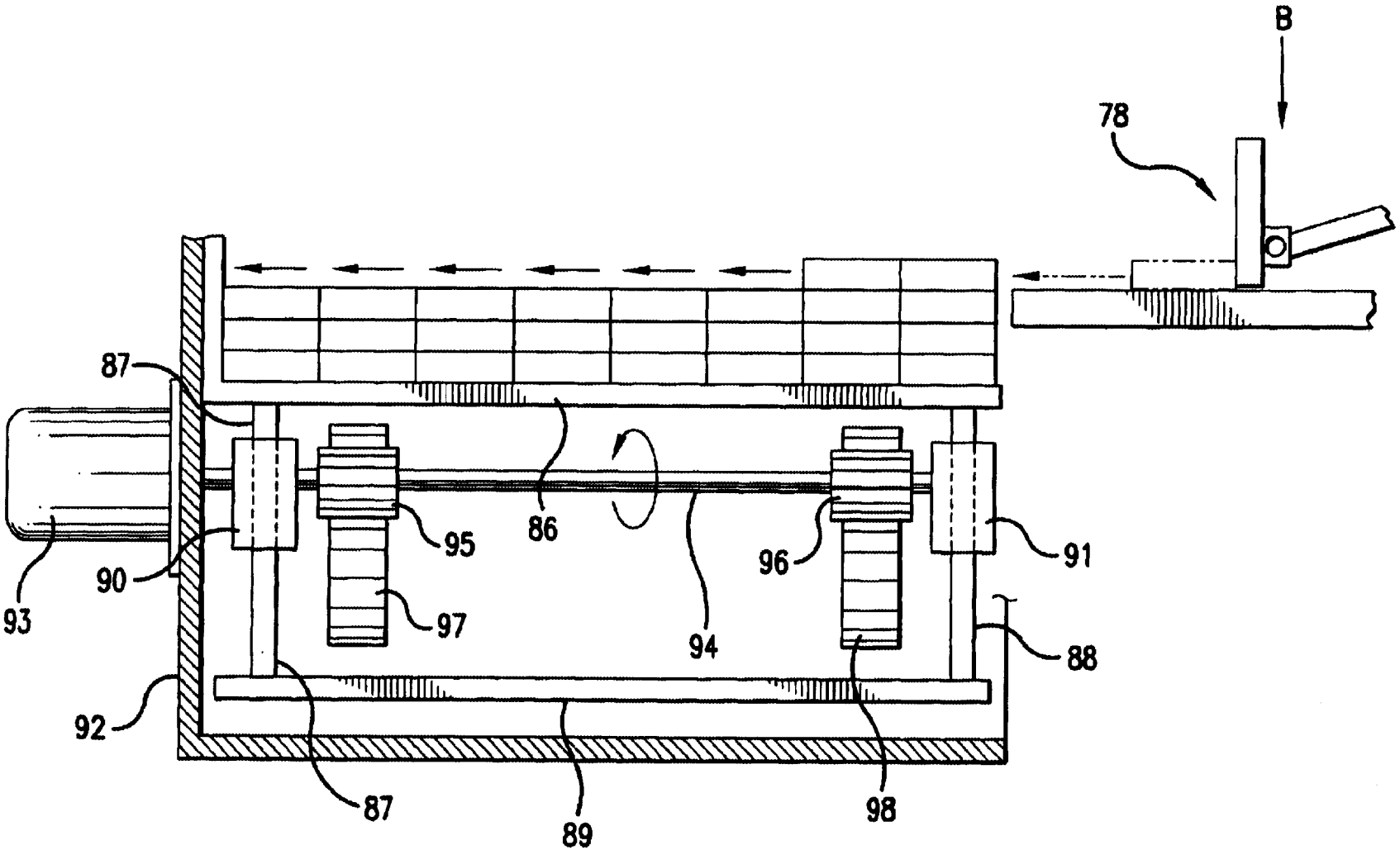
FIG. 29 is a view explaining the configuration of a table-raising mechanism for a pieces-arranging table.

As shown in FIGS. 28 and 29, a pieces-arranging table 86 is disposed ahead of and extends continually from the flat piece-pushing and transferring passage 85, so as to move upward and downward. On the bottom side of the pieces-arranging table 86 are mounted one ends of shafts 87 and 88. At the other ends of the shafts 87 and 88 is mounted a transverse member 89 connecting the shafts 87 and 88. The shafts 87 and 68 are provided at their intermediate positions with shaft recipient members 90 and 91, respectively, so as to extend or contract, that is, raise or lower the pieces-arranging table 86. On the other hand, a step motor 93 is mounted on an outer side of a support frame 92 and an output shift 94 of the step motor 93 is rotatably disposed through the shaft recipient member 90 to the shaft recipient member 91. The output shaft 94 is provided with two pinions 95 and 96 at separate positions yet between the shaft recipient members 90 and 91 in a secure way. Further, two racks 91 and 98 are secured to the support frame 92 so as to be in mesh with the respective pinions 95 and 96. The pieces-arranging table 86 is configured so as to change its height in four stages in accordance with the status of an arrangement of the pieces 4 by means of a table-raising mechanism C.

The action of the pieces-pushing and arranging mechanism C will be described hereinafter in more detail.

The pieces 4 are conveyed from the pieces-determining and turning mechanism B one by one to a predetermined position of the piece-pushing and transferring passage 85 of the pieces-pushing and arranging mechanism C (FIG. 26A), while the pieces are stayed with their top faces directed downward and their back faces directed upward. As the piece is transferred and delivered to the predetermined position of the piece-pushing and transferring passage 85, the step motor 83 is driven by means of the control unit, and the drive force of the step motor 83 is transmitted via the output shaft 84 to the circular plate 75 that in turn starts rotating with the output shaft 84 as a center of rotation. This rotation causes the crank shaft 77 to push the piece-pushing member 78 forward from its backward position B (FIG. 26B), thereby pushing the piece out toward the pieces-arranging table 86. The lengthwise movement of the piece can be restricted by a conventional restricting member (not shown) during the course where the piece is being transferred and delivered to pieces-arranging table 86. As the circular plate 75 is rotated half, the piece-pushing member 78 reaches the forward position F at which the piece is pushed out onto the pieces-arranging table 86. Thereafter, the circular plate 75 is further rotated another half, then the piece-pushing member 78 is returned to its original position, i.e., the backward position B.

It is to be noted herein that, when the piece is to be turned upside down by means of the pieces-determining and turning mechanism B, the step motor 83 is rotated at a predetermined angle on the basis of an instruction from the control unit and the piece-pushing member 18 is transferred from the backward position B (FIG. 26B) to the middle position M (FIG. 27) and stayed there in a rest state to allow the piece to be held inside the face-reversing device 65. After the face of the piece is reversed, the step motor 83 is rotated in an inverse direction to return the pushing member 78 to its backward position B, following the pieces-pushing action as described above.

As a piece of the piece is pushed out one by one onto the pieces-arranging table 86 by the piece-pushing member 78, the new piece of the piece pushes forward another piece of the piece that has been pushed out and delivered thereinto from the piece-pushing member. This pushing action is repeated until a predetermined number of pieces of the pieces (in this embodiment, eight pieces) are lined up sideways in a row of, e.g., eight pieces in this embodiment. Once a row of a predetermined number of pieces is arranged, the step motor 93 starts rotating on the basis of an instruction from the control unit that receives the information on the number of the passed pieces by means of the position sensor 53. And a first row of the pieces is lowered by a distance corresponding to the height of each piece of the one row. Then, pieces of the pieces are pushed out and delivered one by one onto the first row of eight pieces until a second row of eight pieces is superimposed over the first row. Likewise, the action of pushing and delivering pieces of the pieces is repeated until a set consisting of four rows of the pieces, each row comprised of eight pieces, is formed on the pieces-arranging table 86.

In the above embodiment, the pushing action is carried out by means of the crank shaft. The pushing action is not restricted to the use of the crank shaft, however, and any means can be used as long as it can accomplish the object sought to be achieved. For example, a combination of a rack with a pinion can also be utilized for arranging a set of the pieces. In this embodiment, the rack is mounted at its one end portion on the pushing plate, and the pushing plate may be moved among the backward position B, the middle position M, and the forward position F by adjusting the direction of rotation of the pinion and the amount of rotation thereof.

Pieces-set Pushing and Raising Mechanism D

The pieces-set pushing and raising mechanism D is a mechanism for pushing out an arranged set of the pieces to a predetermined position and raising it from the pieces outlet port 5 on the playing table 2. The pieces-set pushing and raising mechanism D comprises a pieces-set pushing mechanism 101 and a pieces-set raising mechanism 102.

Figure 30:
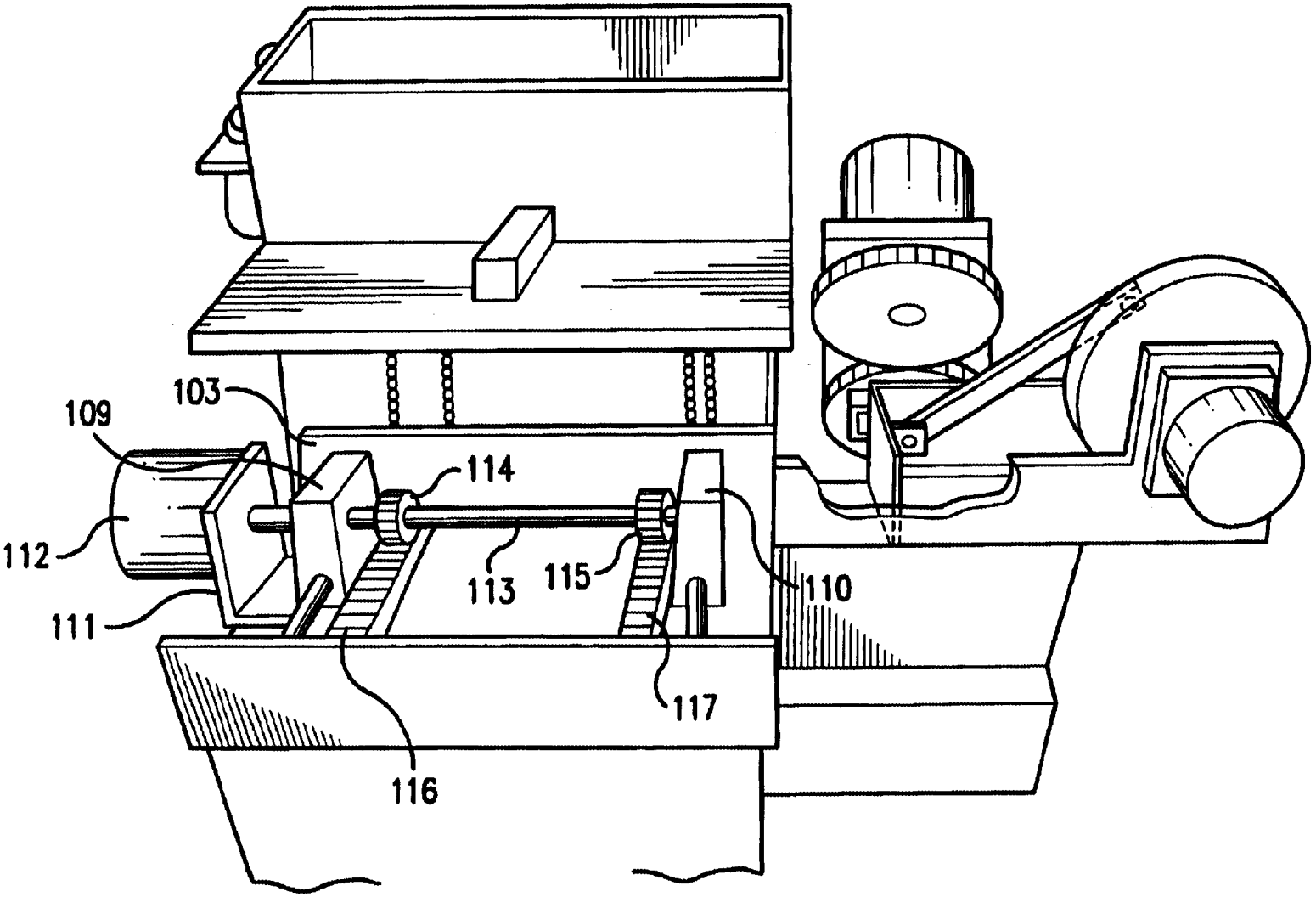
FIG. 30 is a perspective view showing the configuration of a pieces-set pushing and raising mechanism.
Figure 31:
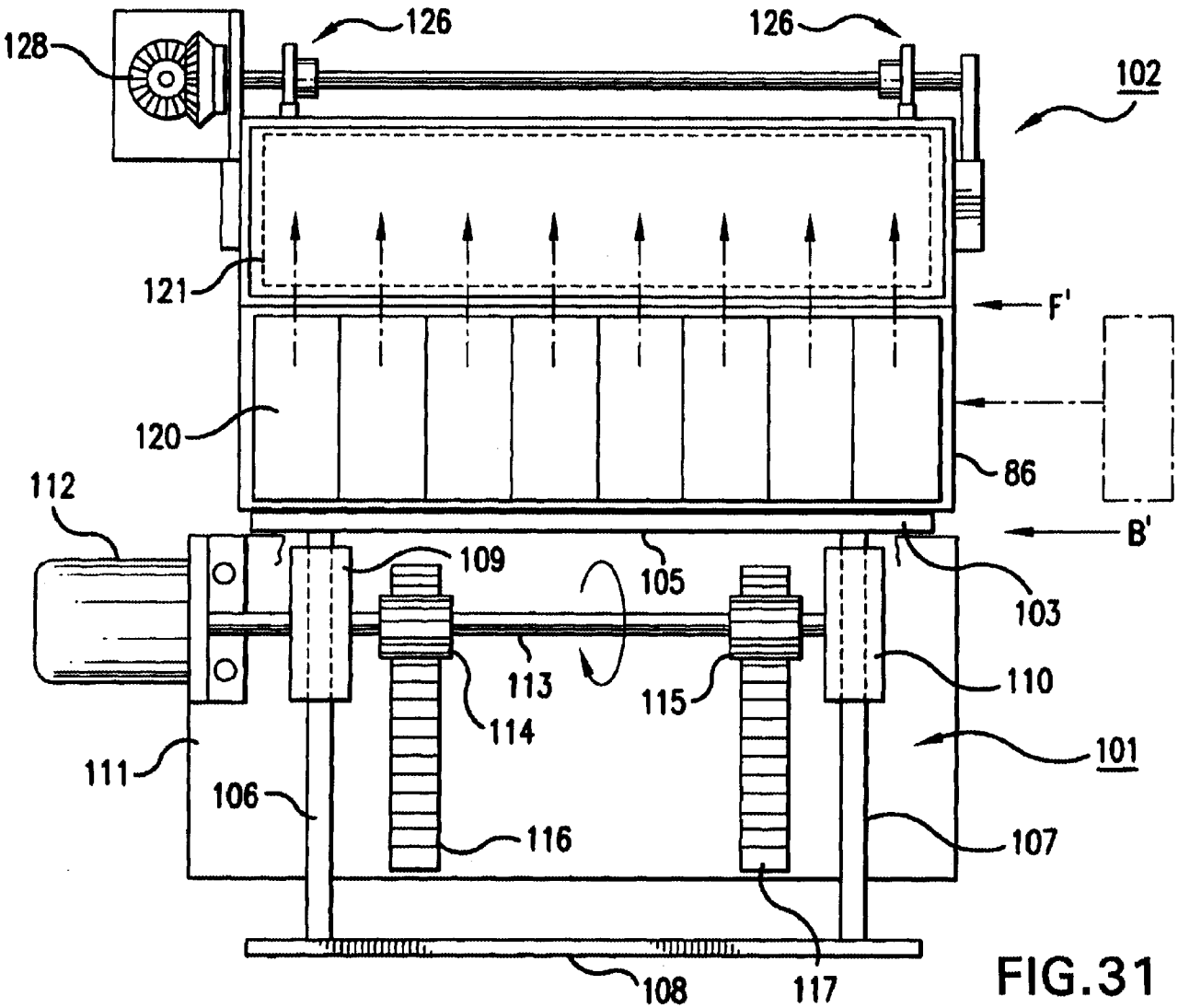
FIG. 31 is a plan view showing the configuration of the pieces-set pushing and raising mechanism.

The pieces-set pushing mechanism 101 is disposed on a side of the pieces-arranging table 86. As shown in FIGS. 30 and 31, the pieces-set pushing mechanism 101 comprises a pieces-set pushing member 103. On a side 105 of the pieces-set pushing member 103 on its opposite side of a pushing side 104 thereof are mounted two shafts 106 and 107, each extending parallel to each other. On the opposite ends of the respective shafts 106 and 107 is mounted ad member 108 connecting the two shafts. The shafts 106 and 107 are provided at their intermediate positions with shaft recipient members 109 and 110, respectively, so as to move each in the axial direction of the shaft. On the other hand, a step motor 112 is mounted on an outer side of a support frame 111, and an output shaft 113 of the step motor 112 extends rotatably through the shaft recipient member 109 to the shaft recipient member 110 within the support frame 111. The output shaft 113 is secured with two pinions 114 and 115 at separate positions between the shaft recipient members 109 and 110, respectively. Two racks 116 and 117 are secured to the support frame 111 so as to be in mesh with the respective pinions 114 and 115. The pieces-set pushing member 103 is disposed so as to move in a reciprocal way between a backward position B' (FIG. 31) and a forward position F' (FIG. 31) by means of the pieces-set pushing mechanism 101. Reference numeral 120 sets forth a set of the pieces.

Figure 32:
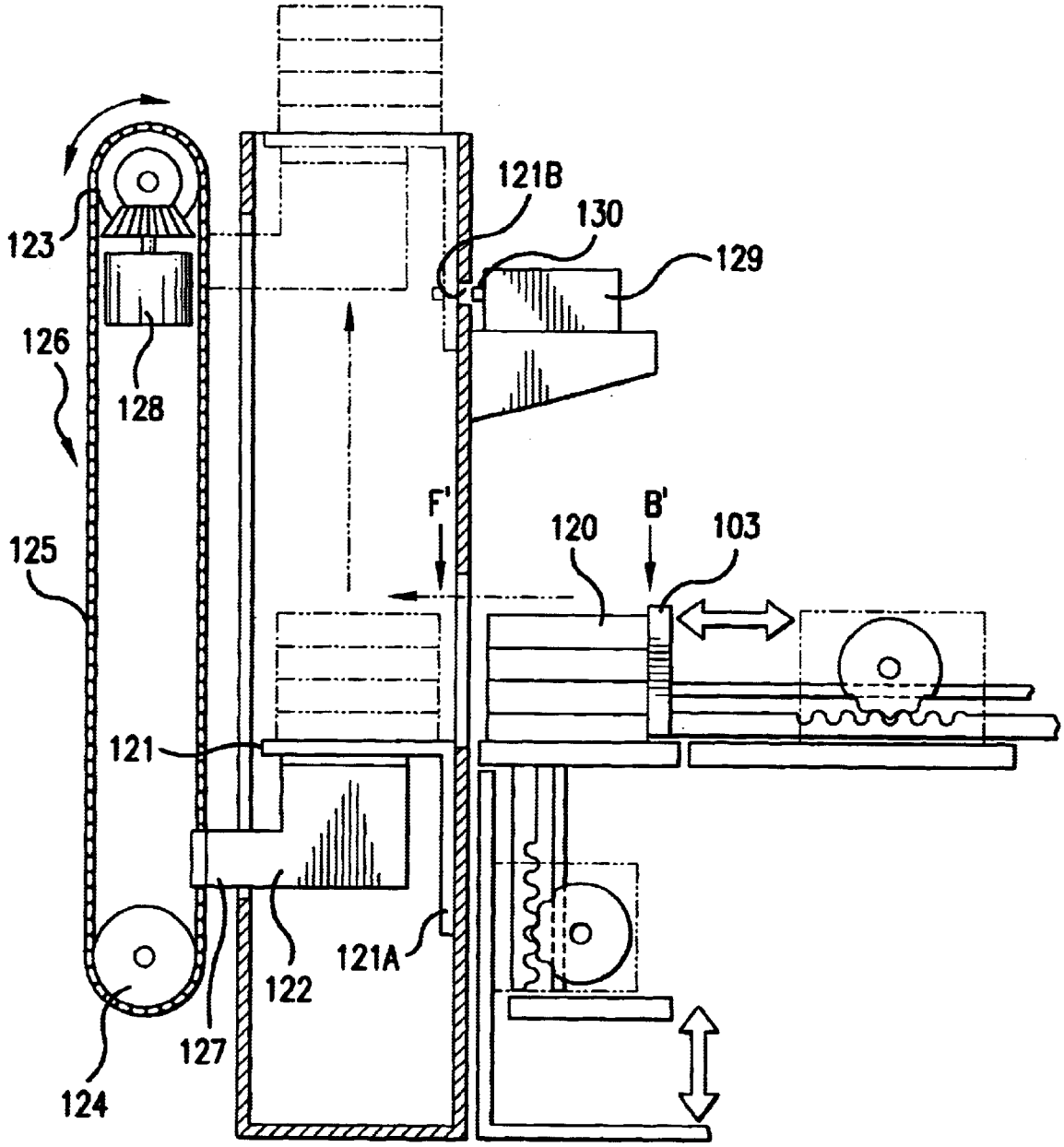
FIG. 32 is a side view showing the configuration of a raising mechanism.

As shown in FIG. 32, the pieces-set raising mechanism 102 has a pieces-set placing table 121 on which to place an arranged set 120 of the pieces pushed out from the pieces-pushing and arranging mechanism C by means of the pieces-set pushing member 103. Underside of the pieces-set placing table 121 is disposed a support member 122 that supports the pieces-set placing table 121. As shown in FIGS. 5 and 32, a pieces-set raising member 126 comprises a pair of pulleys 123 and 124 and a chain 125 winding the pair of the pulleys 123 and 124. Two sets of the pieces-set raising members 126 are disposed in the direction parallel to the row direction of the arranged set 120 of the pieces. At an appropriate position of the chain 128 is secured a top portion of a connecting member 127 extending transversely from the support member 122. On the other hand, a step motor 123 is disposed on a support frame (not shown) and it can rotate the pulley 123 in normal and inverse directions by a conventional drive system using a bevel gear. A vertical wall section 121A of the pieces-set placing table 121 is provided with a slit 121B at its appropriate position. At the raising position at which the pieces-set placing table 121 is raised, a pin 130 of a stopper 129 is engaged with the slit 121B to hold the pieces-set placing table 121 in a rest position.

Then, the action of the pieces-set pushing and raising mechanism D will be described.

As the arrangement of the set 120 of the pieces by means of the pieces-pushing and arranging mechanism C was finished, as shown in FIG. 31, the step motor 112 is driven on the basis of an instruction from the control unit, and the drive force from the step motor 112 is transmitted from the output shaft 113 via the pinions 114 and 115 to the respective racks 116 and 117 to transfer the pieces-set pushing member 103 from its backward position B' to the forward position F'. This movement allows the arranged set 120 of the pieces to be pushed out and delivered onto the pieces-set placing table 121 lowered at its lower position for receiving a new set of pieces. After pushing out and delivering the arranged set 120 of the pieces thereonto, the pieces-set pushing member 103 is returned to its backward position B'. As the pieces set 120 has been placed on the pieces-set placing table 121, this placement is detected by a sensor (not shown) and a signal indicative of the placement is transmitted to the control unit. The control unit then issues an instruction to drive the step motor 128, and the step motor 128 is driven in a predetermined amount to transfer the chain 125 in a counterclockwise direction and to raise the pieces-set placing table 121 on a level with the top surface of the playing table 2. As the pieces-set placing table 121 is raised up to the same height as the top surface of the playing table 2, the pin 130 of the stopper 129 is engaged with the slit 121B formed at an appropriate position of the vertical wall 121A of the pieces-set placing table 121, and the pieces-set placing table 121 is brought into a rest status ready for playing a new game. On the other hand, in order to pick up a new set of the pieces 120, the pieces-set placing table 121 is lowered to the position at which a new set of the pieces 120 is to be delivered and placed by carrying out the inverse operations for raising the pieces set 120 onto the playing table.

The Pieces-entry Door Opening and Closing Mechanism E

The pieces-entry door opening and closing mechanism E for discharging the pieces used for a previous game is a mechanism for opening the piece outlet port 6 by switch operations to discharge the pieces used for the game from the playing table 2 into the main apparatus body 7 after the game was over and for closing it by switch operations after all the pieces were discharged from the playing table.

Figure 33:
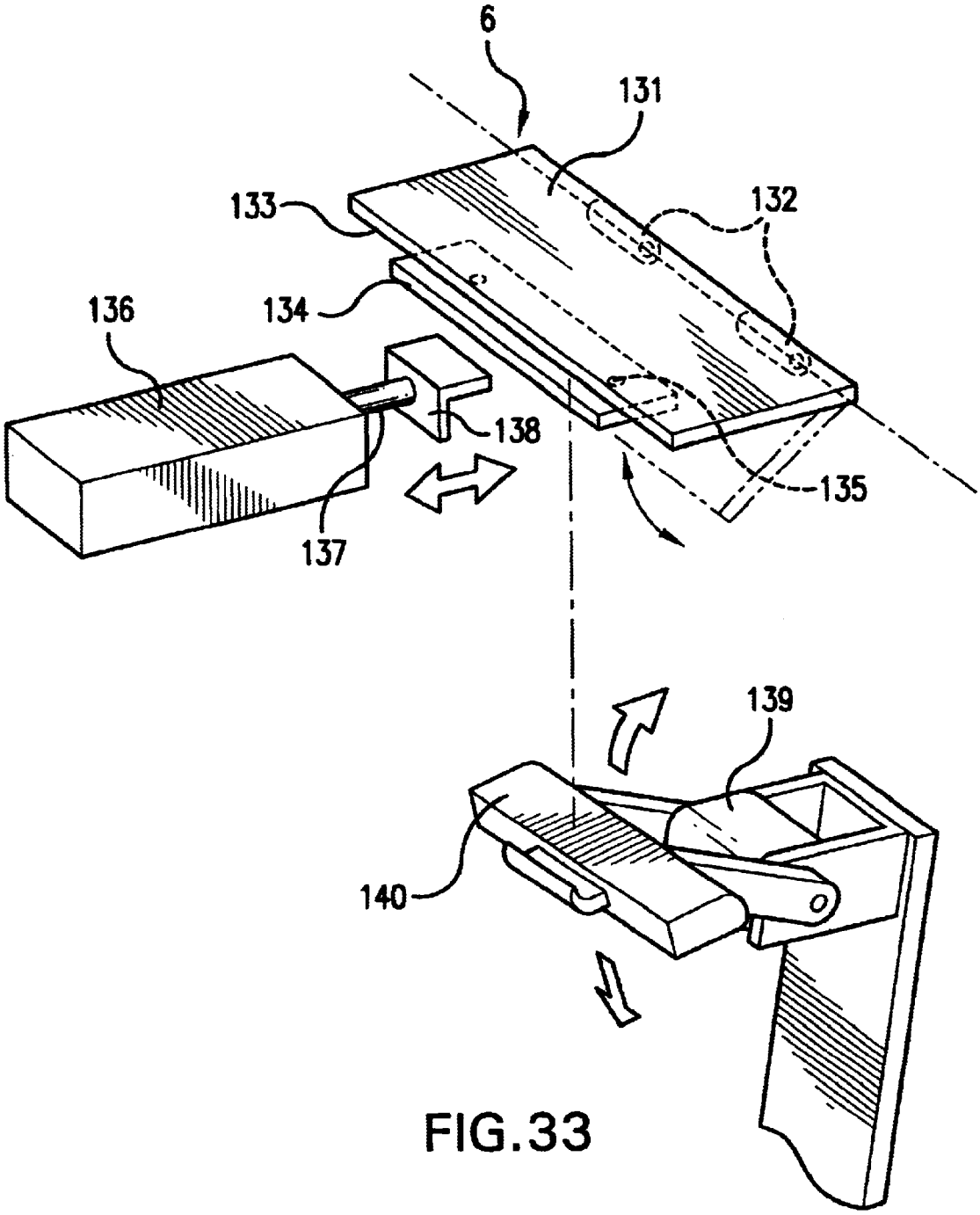
FIG. 33 is a perspective view showing the configuration of a door-opening and closing mechanism for discharging the pieces used for a game.

FIG. 33 shows an example of the pieces-entry door opening and closing mechanism E. The piece outlet port 6 is provided with a door 131 that is secured at its one end side to a side edge of the piece outlet port 6 with a hinge 132 so as to pivot between a horizontal position and a downward inclining position, as shown in the drawing. Underneath the other end side of the door 131 is secured a plate member 134 with a conventional fixing means 135 such as a vise so as to form a clearance 133 having a width somewhat spaced from the back surface of the door. An electromagnetically operable actuator 136 is disposed in the vicinity of the door 131, and an operating shaft 137 of the actuator 136 is provided with an insert piece 138 at its tip so as to move in forward and rearward directions. The insert piece 138 in the forward position is inserted into the clearance 133 to hold the door 131 at its horizontal position. On the other hand, the insert piece 138 in the rearward position is discharged from the clearance 133 to allow the door 131 to assume its downward inclining position and to be opened. Moreover, the step motor 139 secured within the support frame disposed at an end of a slender plate member is fixed at its both sides to brackets, and a raising piece 140 is mounted on the brackets so as to move in upward and downward directions. The raising piece 140 is arranged so as to come into abutment with the plate member 134 as it is raised to its raised position.

Then, a description will be given regarding the action of the pieces-entry door opening and closing mechanism E.

Figure 34A:
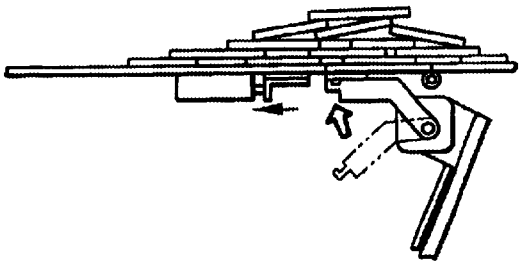
FIG. 34A is a view explaining the action of the door-opening and closing mechanism.
Figure 34B:
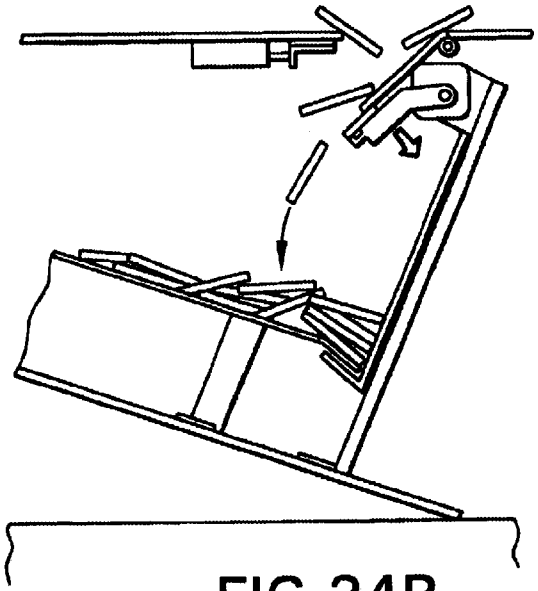
FIG. 34B is a view explaining the action of the door-opening and closing mechanism.
Figure 34C:
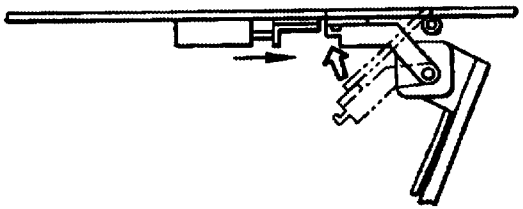
FIG. 34C is a view explaining the action of the door-opening and closing mechanism.
Figure 34D:
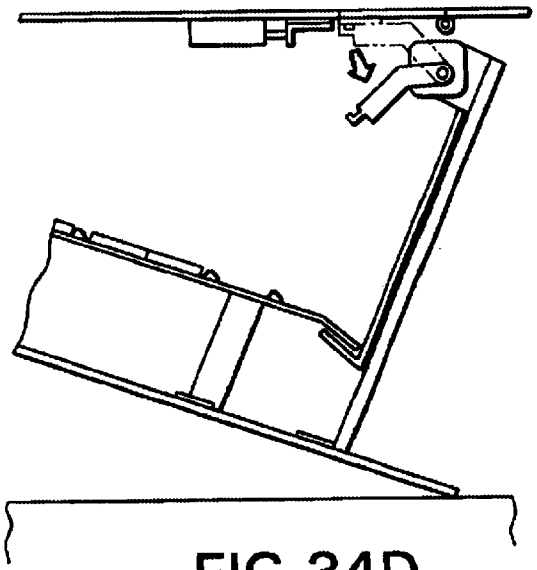
FIG. 34D is a view explaining the action of the door-opening and closing mechanism.

Once one game was over, the pieces used for the game are discharged from the playing table 2 into the main apparatus body 7 by pressing a switch although not shown. As the switch is pressed, the step motor 139 starts rotating to raise the raising piece 140 mounted at its tip and allow the raising piece 140 to come into touch with the plate member 134. As the raising piece 140 came into touch with the plate member 134, then the insert piece 138 is discharged from the clearance 133 by the operation of the actuator 136 to open the door 131 (FIG. 34A). Then, the step motor 139 is rotated in an inverse direction to move the raising piece 140 in the downward direction to its downward inclining position. As the raising piece 140 is moved to its downward inclining position with the hinge 132 as an axis, the pieces on the playing table are dropped into the main apparatus body 7 through the piece outlet port and discharged from the playing table (FIG. 34B). Once all the pieces were discharged from the playing table, the step motor 139 starts rotating to move the raising piece 140 upward to its raised position to come into abutment with the plate member 134. In this state, the actuator 136 is operated to insert the insert piece 138 into the clearance 133 to allow the door 131 to stay in its closed status (FIG. 34C). Thereafter, the step motor 139 is rotated in an inverse direction to lower the raising piece 140 and the playing table is ready for playing another game (FIG. 34D).

Pai Gow Cards

The Pai Gow pieces to be used for the Pai Gow table system according to the present invention are prepared for use appropriate to determine their top and back faces by a sensor. In this sense, conventional pieces for Pai Gow games cannot be used with the Pai Gow table system of the present invention. The pieces for use in the present invention may be prepared to allow their top and back faces to be sensed and determined by an optical sensor or a magnetic senor or otherwise. The pieces themselves may be made of synthetic plastic material that is opaque and colored so that a mark provided on one side cannot be seen through from the opposite side. Such a plastic material may include, for example, acryl resin, polyester resin, urea resin, melamine resin, phenol resin, epoxy resin, or any other material suitable for use. When the determination of the top and back faces of the pieces is to be made by means of an optical means, the side oh which a mark is to be provided may be processed by coating a material having a reflectivity different from that of the surface on the opposite side, superimposing a layer having such a different reflectivity, or mounting or incorporating a member having such a different reflectivity. The distinction of the top face of the piece with a mark provided thereon from the back face thereof with no mark thereon can be determined by the difference of such a reflectivity or any other appropriate parameter. Likewise, when the top and back faces of the pieces are to be determined by means of a magnetic means, a magnetic material is used in place or an optical material. Such a magnetic material may include, for example, ferrite, etc. In this case, the pieces may be prepared in substantially the same manner by coating a magnetic material only on the side on which a mark is to be provided, superimposing a magnetic layer or a layer containing such a magnetic material, or mounting or incorporating a member that can be detected magnetically. In this case, the determination of the top faces of the pieces can be made from the back faces thereof by measuring the difference in magnetic magnitude between the top and back faces of the pieces.

With the configuration as described above, the present invention provides the Pai Gow table system that can automatically carry out a series of operations including, for example, mixing the pieces, directing the one faces of all the pieces to one direction, arranging a set of the pieces, supplying the set of the pieces, and so on. The provision of this system presents the advantages that the number of games per unit time can be increased greatly and the fairness of the game can be improved remarkably.

With the configuration of the turn table and the pieces-mixing and arranging mechanism in the above manner, the clogging or superimposition of the pieces after mixing can be controlled effectively and the pieces can be transferred one by one smoothly.

With the configuration of the pieces-determining and turning mechanism in the above manner, the pieces can be rapidly and surely arranged with their one faces directed to one direction. This can serve as minimizing troubles involved in mixing the pieces or the like and securing fairness in playing games.

The system having the pieces-pushing and arranging mechanism in the above manner can arrange a set of the pieces in rapid and sure ways so that troubles that may occur during playing games can be minimized.

In addition, the pieces-set pushing and raising mechanism can serve as supplying a set of the pieces rapidly and surely.

What is claimed is:

1. An automatic Pai Gow table apparatus having a table top providing a playing surface with a piece inlet port and a piece outlet port, and a main mechanical section disposed underneath the table top, said apparatus being used for playing a game with pieces fed from said piece outlet port; wherein the main mechanical section comprises:

(a) a rotatable turntable for receiving the pieces cast from the piece outlet port, for mixing the received pieces, and for transferring the pieces one by one after mixing the pieces;

(b) face-determining means for determining a top face with a mark provided thereon or a back face with no mark provided thereon for each piece transferred from the turntabl;

(c) face-turning means for turning over a piece on the basis of a result of determination by the face-determining means to reverse the top face of the piece when it is determined that the top face thereof is directed upward and for allowing the piece to pass when it is determined that the back face of the piece is directed upward;

(d) pieces-pushing and arranging means for pushing out and delivering the piece with the back face thereof directed upward to a predetermined position and arranging the pieces into a set of the pieces having a predetermined number of rows;

(e) pieces-set pushing and transferring means for pushing out and delivering the set of the pieces arranged by the pieces-pushing and arranging means to the piece inlet port of the playing surface;

(f) a circular member mounted under said turntable for rotation therewith, said circular member having a periphery with evenly spaced cutouts; and (g) at least one sensor for detecting the presence of a cutout at a predetermined position, thereby monitoring rotation of the turntable.

2. The Pai Gow table system as claimed in claim 1, wherein:

the turntable is mounted rotatably directly below said outlet port and has a planar surface for receiving pieces from said piece outlet port, said planar surface being inclined with respect to a horizontal plane.

3. The Pai Gow table system as claimed in claim 1 further comprising:

position detection means for detecting a position of the piece, which is disposed in a piece guide passage disposed on a downstream side of the turntable together with the face-determining means; and a control unit for controlling action of each of (a) through (g) on the basis of information from the face-determining means and/or the position detection means.

4. The Pai Gow table system as claimed in claim 1, further comprising:

a door opening and closing mechanism for automatically opening and closing a door disposed in the piece outlet port.

5. The Pai Gow table system as claimed in claim 2, wherein the turntable comprises said planar surface, as a central surface portion and an annular tapered surface portion surrounding and contiguous with said planar surface.

6. The Pai Gow table system as claimed in claim 5, wherein:

plural projection members are disposed at a predetermined interval around an outer peripheral portion of said planar surface and on the annular tapered surface portion.

7. The Pai Gow table system as claimed in claim 6, wherein:

each of the projection members comprises a spring member made from a single wire with one end portion curved upward;

a plurality of slits are formed at a predetermined interval in said outer peripheral portion of said planar surface and in said annular tapered surface portion; and a spring member is inserted into and through each of the plurality of the slits so that a part of the upward curved portion protrudes upward from the slit.

8. The Pai Gow table system as claimed in claim 1, wherein:

said turntable comprises a planar central surface portion and an annular tapered surface portion surrounding and contiguous with the planar central surface portion, the planar central surface portion being inclined with respect to a horizontal plane; and further comprising:

a peripheral wall member enclosing the periphery of the turntable; and a drive means for rotatably driving the turntable.

9. The Pai Gow table system as claimed in claim 8, wherein:

a first slit is provided in the peripheral wall member in a position close to the highest position of the turntable and a second slit is provided in a position somewhat upstream of the first slit;

a first propeller member is rotatably mounted in the vicinity of the first slit for rotation in a first direction with a part thereof protruding from the first slit over the turntable; and a second propeller member having a size smaller than the first propeller member is rotatably mounted in the vicinity of the second slit for rotation in a second direction, opposite the first direction, with a part thereof protruding from the first slit over the turntable.

10. The Pai Gow table system as claimed in claim 1, wherein:

the face-determining means optically detects the top face or the back face of the piece.

11. The Pai Gow table system as claimed in claim 1, wherein:

the face-determining means magnetically detects the top face or the back face of the piece.

12. The Pai Gow table system as claimed in claim 1, further comprising:

at least one sensor for sensing a position of the piece.

13. The Pai Gow table system as claimed in claim 1, wherein;

the face-turning means comprises a a piece-accommodating section for temporarily accommodating the piece therein; and a piece-holding member for assuming a piece-holding position for holding the piece on an outlet side of the peace-accommodating section when the face of the piece is reversed and for assuming a non-piece holding position when the face of the piece is not reversed.

14. The Pai Gow table system as claimed in claim 1, wherein said pieces-pushing and arranging means comprises:

a piece-pusher for pushing out the piece with the back face thereof directed upward and the top face thereof directed downward, one by one, onto a pieces-arranging table; and table-transferring means for transferring the pieces-arranging table by a predetermined amount corresponding to a thickness of the piece; and wherein the pieces are arranged in a row having a predetermined number of pieces by pushing the pieces one by one with the piece-pusher onto the pieces-arranging table and the row of the pieces is transferred downward by the predetermined amount by lowering the pieces-arranging table, overlaying another row of the predetermined number of pieces over the previous row, following the repetition of the action of pushing the pieces and lowering the pieces-arranging table to form a set of the pieces comprised of a predetermined number of rows of pieces.

15. The Pai Gow table system as claimed in claim 14, wherein:

the piece-pusher comprises a pushing member driven by a crankshaft.

16. The Pai Gow table system as claimed in claim 15, wherein:

the piece-pusher comprises a step motor, a circular plate member fixed on an output shaft of the step motor at its central portion, and a pushing plate disposed so as to come into abutment with the piece upon pushing the piece, one end of the crankshaft being attached at an eccentric position of the circular plate member and its other end being attached to the pushing plate.

17. The Pai Gow table system as claimed in claim 15, wherein:

the piece-pusher comprises a pushing member driven by a pinion and a rack; and a pushing plate is mounted on one end of the rack, which comes into abutment with the piece upon pushing the piece and whose position is controlled by direction and amount of rotation of the pinion.

18. The Pai Gow table system as claimed in claim 14, further comprising:

table-raising means for raising and lowering said pieces-arranging table, said table raising means, comprising a pulse motor and a drive force transmission system comprising a pinion and a rack for transmitting drive force of the pulse motor to the pieces-arranging table.

19. The Pai Gow table system as claimed in claim 1, wherein said pieces-set pushing and transferring means comprises:

a pieces-set placing table for placing a set of the pieces to be supplied onto the playing surface;

a pieces-set pushing means for pushing out and delivering an arranged set of the pieces to a predetermined position on the pieces-set placing table and returning to its original position after delivering the set of the pieces; and table-transferring means for transferring the pieces-set placing table with the set of the pieces placed thereon to level of the top surface of the playing surface to supply the set of the pieces and for lowering the pieces-set placing table down for receiving a new set of pieces arranged for a next game.

20. The Pai Gow table system as claimed in claim 19, wherein:

said pieces-set pushing means comprises a pushing plate disposed so as to come into abutment with the set of the pieces for pushing the set of the pieces, a pulse motor, and a drive force transmission system comprising a pinion and a rack for transmitting drive force of the pulse motor to the pushing plate.

21. The Pai Gow table system as claimed in claim 19, wherein:

said table-transferring means comprises a pulse motor, a support member for supporting the pieces-set placing table, and a drive force transmission system comprising a pair of pulleys and a belt wound around the pair of the pulleys, with the belt connected to the support member.

22. The Pai Gow table system as claimed in claim 1, wherein:

each of the pieces has either its top face or its back face coated with a material that can be determined by the face-determining means.

23. The Pai Cow table system as claimed in claim 1, wherein:

each of the pieces has either its top face or its back face provided with a layer that can be determined by the face-determining means.

24. The Pai Gow table system as claimed in claim 1, wherein:

each of the pieces has either its top face or its back face provided with a member that can be determined by the face-determining means.

25. The Pai Gow table system as claimed in claim 1 further comprising:

(h) reversing means for reversing direction of rotation of said turntable for a predetermined period of time, responsive to signal from said at least one sensor indicating stoppage of rotation of said turntable, to unclog a piece from the piece outlet port.

26. An automatic Pai Gow table apparatus having a table top providing a playing surface with a piece inlet port and a piece outlet port, and a main mechanical section disposed underneath the table top, said apparatus being used for playing a game with pieces fed from said piece outlet port; wherein the main mechanical section comprises:

(a) a rotatable turntable for receiving the pieces cast from the piece outlet port, for mixing the received pieces, and for transferring the pieces one by one after mixing the pieces;

(b) face-determining means for determining a top face with a mark provided thereon or a back face with no mark provided thereon for each piece transferred from the turntable;

(c) face-turning means for turning over a piece on the basis of a result of determination by the face-determining means to reverse the top face of the piece when it is determined that the top face thereof is directed upward and for allowing the piece to pass when it is determined that the back face of the piece is directed upward;

(d) pieces-pushing and arranging means for pushing out and delivering the piece with the back face thereof directed upward to a predetermined position and arranging the pieces into a set of the pieces having a predetermined number of rows;

(e) pieces-set pushing and transferring means for pushing out and delivering the set of the pieces arranged by the pieces-pushing and arranging means to the piece inlet port of the playing surface;

(f) a cylindrical wall member surrounding the periphery of the turntable and having at least one circumferentially extending slit;

(g) a first rotatable member rotatably mounted adjacent said one slit with a portion thereof protruding through said one slit to over the turntable; and (h) first drive means for rotatably driving said first rotatable member.

27. The Pai Gow table system as claimed in claim 26 wherein said cylindrical wall member has a second circumferentially extending slit located in a position somewhat upstream of said one circumferentially extending slit and further comprising:

(i) a second rotatable member rotatably mounted adjacent said second slit with a portion thereof protruding through said second slit to over the turntable; and (j) second drive means for rotatably driving said second rotatable member in a direction opposite the direction of rotation of said first rotatable member.

28. The Pai Gow table system as claimed in claim 27 wherein said first and second rotatable members have peripheral projections for engaging and knocking down pieces not lying flat on said turntable.

29. The Pai Gow table system as claimed in claim 28 wherein said second rotatable member has a diameter smaller than that of said first rotatable member.

30. The Pai Gow table system as claimed in claim 26 wherein said first rotatable member has peripheral projections for engaging and knocking down pieces not lying flat on said turntable.

31. The Pai Gow table system as claim in claim 26 wherein said cylindrical wall member extends perpendicular to a planar central surface portion of said turntable.

* * * * *